US008347497B2

(12) United States Patent
Harada et al.

(10) Patent No.: US 8,347,497 B2
(45) Date of Patent: Jan. 8, 2013

(54) PROCESSING METHOD, PROCESSING JIG FOR CYLINDER BLOCK AND THE CYLINDER BLOCK

(75) Inventors: Takahiro Harada, Chiryu (JP); Kazuhiro Asayama, Nagoya (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 673 days.

(21) Appl. No.: 12/527,642

(22) PCT Filed: Feb. 15, 2008

(86) PCT No.: PCT/JP2008/053011

§ 371 (c)(1),
(2), (4) Date: Aug. 18, 2009

(87) PCT Pub. No.: WO2008/102858

PCT Pub. Date: Aug. 28, 2008

(65) Prior Publication Data

US 2010/0050433 A1 Mar. 4, 2010

(30) Foreign Application Priority Data

Feb. 22, 2007 (JP) ..... 2007-42882

(51) Int. Cl.
*B21K 3/00* (2006.01)
*F02F 1/10* (2006.01)
*F02B 75/18* (2006.01)

(52) U.S. Cl. ..... 29/888.06; 29/888.01; 123/195 R

(58) Field of Classification Search ..... 29/281.3, 29/888.06, 888.061; 123/195 R; 269/101
See application file for complete search history.

(56) References Cited

U.S. PATENT DOCUMENTS

| | | | | |
|---|---|---|---|---|
| 3,260,097 | A * | 7/1966 | Hilton | 72/393 |
| 6,973,367 | B2 * | 12/2005 | Klink et al. | 700/159 |
| 7,851,046 | B2 * | 12/2010 | Nishimura et al. | 428/141 |
| 8,033,534 | B2 * | 10/2011 | Shinkai et al. | 269/40 |
| 8,047,515 | B2 * | 11/2011 | Asayama | 269/101 |
| 2009/0172943 | A1 * | 7/2009 | Rolling | 29/888.06 |
| 2010/0066000 | A1 * | 3/2010 | Asayama | 269/101 |

FOREIGN PATENT DOCUMENTS

| | | | |
|---|---|---|---|
| JP | 63-118494 | A | 5/1988 |
| JP | 03-026460 | A | 2/1991 |
| JP | 07-091311 | A | 4/1995 |
| JP | 08-252764 | A | 10/1996 |

(Continued)

OTHER PUBLICATIONS

Koji Mizuno: *Processing Method for Cylinder Bore*, Toyota Technical Review, Jan. 31, 2002, Toyota Motor Corp., pp. 163-164 with English translation.

*Primary Examiner* — Alexander P Taousakis
(74) *Attorney, Agent, or Firm* — Kenyon & Kenyon LLP

(57) ABSTRACT

In a processing method for processing a cylinder block, a finish processing for the cylinder bore is performing, by pressing the portion of the bolt phase for fastening the cylinder head on the cylinder portion outer peripheral surface forming the inside surface of a water jacket, on the condition that the rigidity of the pressed portion on the cylinder portion toward the pressure from the side of the cylinder bore (the surface pressure from the grinding stones by honing process) is enhanced compared with the other portions.

10 Claims, 13 Drawing Sheets

FOREIGN PATENT DOCUMENTS

| | | | |
|---|---|---|---|
| JP | 09-085610 | A | 3/1997 |
| JP | 2000-271853 | A | 10/2000 |
| JP | 2000-291487 | A | 10/2000 |
| JP | 2004-243514 | A | 9/2004 |
| JP | 2004-340001 | A | 12/2004 |
| JP | 2005-199378 | A | 7/2005 |
| JP | 2007-154865 | A | 6/2007 |
| JP | 2008-062308 | A | 3/2008 |

* cited by examiner (a)

(b)

PROCESSING METHOD, PROCESSING JIG FOR CYLINDER BLOCK AND THE CYLINDER BLOCK

This is a 371 national phase application of PCT/JP2008/053011 filed 15 Feb. 2008, claiming priority to Japanese Patent Application No. 2007-042882 filed 22 Feb. 2007, the contents of which are incorporated herein by reference.

BACKGROUND OF THE INVENTION

1. Field of the Invention

The present invention relates to a method and a jig for processing a cylinder block making up of an internal-combustion engine such as an automobile engine, as well as the cylinder block.

2. Related Art

A cylinder block making up of an internal-combustion engine such as an automobile engine, as a general construction thereof, is provided with a cylinder bore, which slidably incorporates a piston as a cylindrical aperture portion, a cylinder head mounting surface (hereinafter, referred to as "a head mounting surface") onto which a cylinder head is assembled, as an open surface of the cylinder bore. A fastening means (a head bolt) such as a bolt is used in the assembly of the cylinder head onto the head mounting surface. In other words, the head bolt penetrates the cylinder head and is threaded into a blot hole as a female threaded portion provided with the cylinder block, so that the cylinder head is tightly fixed in the cylinder block.

The bolt hole into which the head bolt is threaded in the fixation of the cylinder head in the cylinder block is provided on the periphery of the cylinder bore on the head mounting surface. Specifically, four bolt holes are provided at substantially equal spaces on the periphery of the cylinder bore. Briefly, in this case, for example, in an in-line four-cylinder engine installed on the automobile or the like, two bolt holes out of four bolt holes in line are shared between the adjacent cylinder bores, so that a total of ten bolt holes are provided.

Due to the above construction, a deformation of the cylinder bore (a bore deformation) is caused, during the assembly of the cylinder head into the cylinder block, and at the time of actual working of an engine composed of the cylinder block. In other words, the bore deformation at the time of actual working of the engine includes a deformation caused during the assembly of the cylinder head (hereinafter, referred to as "an assembly deformation") and a deformation caused by a heat load at the time of actual working of an engine. A circularity of the cylinder bore is determined by these bore deformations.

Here, the bore deformation will be concretely described with reference to FIG. 12. In FIG. 12, FIG. 12 (*a*) is a diagram of a single part state (a state that is not assembled), FIG. 12(*b*) is a diagram of the bore deformation during the assembly or at the time of actual working of the engine.

As shown in FIG. 12, as an example of providing the cylinder bore with a bolt fastening portion for fixing the cylinder head to the cylinder block, four bolt fastening portions 110 in one cylinder bore 104 are provided at substantially equal spaces on the periphery of the cylinder bore 104. In the respective bolt fastening portions 110, the head bolt 111 is threaded into a bolt hole 112.

As shown in FIG. 12 (*a*), in the single part state that the cylinder head is not fixed by the fastening of the head bolt 111 threaded into bolt hole 112, as the tightening force (the fastening power) by the head bolt 111 is not added to the cylinder block, the deformation of the cylinder block is not caused due to the action of the fastening power, so that the cylinder bore 104 does not receive the deformation.

As shown in FIG. 12 (*b*), during the assembly in the condition that the cylinder head is tightly fixed into the cylinder block, the tightening force by the head bolt 111 acts on the cylinder block, whereby the tightening force causes the deformation to the cylinder block, thereby leading to the assembly deformation. The assembly deformation is caused due to the fact that the bore upper surface (the peripheral portion of the cylinder bore 104 in the head mounting surface) is strongly pressed by the fastening of the head bolt 111.

Therefore, the periphery of the bolt pressed particularly strongly has a larger deformation, and in the construction that four bolt fastening portions 110 are provided at approximately equal spaces on the periphery of the cylinder bore 104 as the present example, the deformation that the portion of the phase (herein after, referred to as "the bolt phase") corresponding to the bolt fastening portions 110 dwindles inward (expands relatively inward) is caused, in the cylinder bore 104 (see an arrow in FIG. 12 (*b*)). Consequently, as shown in FIG. 12 (*b*), in the assembly deformation, the cylinder bore 104, which was a round shape in the planar view, deforms a cross-like figure (so-called a fourth-order deformation). In the bore deformation caused by the heat load at the time of actual working of the engine, the cylinder bore 104 deformed by the assembly deformation receives the deformation that the cross-like figure thereof is emphasized.

The above-mentioned bore deformation causes the deterioration in the circularity of the cylinder bore. The deterioration in the circularity of the cylinder bore leads to the increase of the friction (the sliding resistance) accompanying the sliding of the piston onto the cylinder bore. The increase of the friction causes to the output limitation of the internal-combustion engine, the deterioration of the fuel consumption or the like.

Specifically, a piston is attached to a piston ring, which slidably contacts the cylinder bore, and the deterioration in the circularity of the cylinder bore causes to the reduction of the sealing characteristics by the piston ring, at the portion where the cylinder bore changes from the perfect circle to the large diameter (the portion expanding the diameter), thereby increasing an engine oil consumption and a blow-by gas due to the leaching. This situation can be prevented by increasing a tension of the piston ring (the expanding force) (by making the tension of the piston ring the high tensile force), so that even the portion changing to the large diameter in the cylinder bore can secure the minimum pressing force by the piston ring. However, the high tensile force of the piston ring leads to the increase of the friction in the whole cylinder bore.

In this regard, in order to restrain the bore deformation at the time of actual working of the engine, the processing method, which can aim for the circularity of the cylinder bore at the time of actual working of the engine, by preliminary adding the deformation in the direction opposite to the bore deformation at the time of actual working of the engine to the cylinder bore, is required, when the finish processing (such as the honing process) so as to obtain the given circularity of the cylinder bore is performed.

Briefly, when the cylinder head is assembled into the cylinder block after the finish processing for the cylinder bore has been performed, the inverse deformation need to be caused so that the cylinder bore becomes a perfect circle, due to the heat load during the assembly of the cylinder head and at the time of actual working of the engine. In other words, the inverse deformation need to be caused, so that the cylinder bore deformed due to the assembly deformation and the deformation by the heat load becomes a perfect circle, at the time of actual working of the engine. For this reason, in the single part state after the finish processing for the cylinder bore has been finished, the inverse deformation as shown in FIG. 13 need to be added to the cylinder bore.

Thus, conventionally, as the processing method that can add the inverse deformation in the single part state after the finish processing for the cylinder bore has been finished, the processing method using a dummy head is known (for example, see JP2004-243514A).

The dummy head is a jig for processing different from the cylinder head assembled as an actual product, and it is assemble into the cylinder block by a head bolt as with the cylinder head, during processing of the cylinder bore. The condition that the cylinder head is assembled into the cylinder block is simulated with the dummy head. Specifically, due to the assembly of the cylinder head into the cylinder block, the predetermined tightening force equivalent to the tightening force with the assembly of the cylinder head is added to the cylinder block, thereby adding the assembly deformation to the cylinder bore. In this situation, the finish processing for the cylinder bore is performed, and the dummy head is removed after the finish processing, so that the inverse deformation is added to the cylinder bore, due to the restoration action accompanying the cancel of the tightening force. The cylinder head is assembled into the cylinder block which the inverse deformation is added to the cylinder bore, thereby restraining the deterioration in the circularity of the cylinder bore due to the bore deformation (the assembly deformation) caused by the tightening force during the assembly of the cylinder head.

However, the processing method using the dummy head requires the respective process of fastening (assembling), disassembling, (removing), washing, delivering or the like of the dummy head, thereby leading to the complexity of process for processing the cylinder block. It is not preferable to complicate the working process, for the improvement of the mass productivity. The processing method using the dummy head requires a preparation of a considerable of dummy heads considering the production cycle time, and equipments for the respective process such as the assembly of the dummy head or the like, thereby increasing the cost.

Consequently, it is an object of the invention to provide a method and a jig for processing a cylinder block, as well as the cylinder block, which can add the deformation in the direction opposite to the bore deformation caused at the time of actual working of the engine to the cylinder bore after the finish processing, so as to restrain the deterioration in the circularity of the cylinder bore at the time of actual working of the engine, without the complexity of the working process and the increase in cost caused by using the jig for processing, in the finish processing for the cylinder bore in the cylinder block.

SUMMARY OF THE INVENTION

The problems to be solved by the present invention is as mentioned above. Next, the means of solving the problems will be described.

In a processing method for a cylinder block according to the first aspect of the present invention, the cylinder block includes a cylinder bore as a cylindrical bore portion which is open on a cylinder head mounting surface onto which a cylinder head is fixed by a fastening member and which slidably incorporates a piston, and a water jacket which is formed so as to surround the cylinder bore via a cylinder portion as a wall portion surrounding the cylinder bore and which is open on the cylinder head mounting surface, and in the processing method, pressed a portion of a periphery of the cylinder portion forming an inner surface of the water jacket, in which the portion is corresponding to a fastened portion by the fastening member in a circular shape of the cylinder bore, then a rigidity is enhanced of the cylinder portion against the pressure from the pressed portion, compared with other portions of the cylinder portion and a finish processing for the cylinder bore is performed.

Accordingly, during the finish processing for the cylinder bore of the cylinder block, the deformation in the direction opposite to the bore deformations caused at the time of actual working of the engine to the cylinder bores after the finish processing can be added, without leading to the complexity of the working process and the increase in cost, which are caused by using the jig for processing such as the dummy head, as well as the deteriorations in the circularity of the cylinder bores at the time of actual working of the engine can be restrained.

In the processing method of the present invention, a pressing member having a wedge surface containing pressing portions separatably connected with each other and receiving a wedge action in a separating direction of the pressing portions, and a wedge member engaging to the wedge surface for adding the wedge action is prepared. The separating direction includes the pressing direction for the portion of the periphery of the cylinder portion and in the state where the wedge action is added from an opening portion of the water jacket toward the cylinder head mounting surface, the pressing member is engaged to the wedge member where the pressing members are inserted into the water jacket, the pressing member is pressed from a side of the opening portion for gaining the wedge action, thereby pressing the portion of the periphery of the cylinder portion.

Furthermore, in the processing method of the present invention, the wedge members are engaged to each of the pressing members inserted for adding the wedge action to the portions of the periphery of the cylinder portion corresponding to the fastened portions, and the wedge members are connected each other in disposing at a position corresponding to that of the inserted pressing members, and the pressing members are supported with the corresponding wedge members being capable of engaging and the wedge members are cooperated for pressing from the side of the opening portion.

Accordingly, during the finish processing for the cylinder bores, the pressing members can be easily inserted into the water jacket, thereby being able to advance the workability of the finish processing for the cylinder bores and to improve the productivity of the cylinder block.

In the processing method of the present invention, the finish processing is a honing process, using a structure comprising a head portion, having a horning stone and moving to the cylinder bore for acting the honing stone on the cylinder bore, and a guide portion, being close to and separated from the cylinder head mounting surface for guiding the head portion and the wedge members is connected to the guide portion. In this embodiment, making the guide portion close to the cylinder head mounting surface causes pressing of the wedge members from the side of the opening portion.

Accordingly, existing constructions and their operations for the honing process during pressing the wedge members toward the pressing members can be used, without the need for additional construction for pressing the wedge members, thereby simplifying the device configuration and improving the workability.

In the alternative embodiment, in the processing method of the present invention, provided is load applying means for applying loads to each of the wedge members engaged to each of the pressing members inserted for adding the wedge action to the portions of the periphery of the cylinder portion corresponding to the fastened portions, for pressing the wedge members from the side of the opening portions, and the load applying means equalizes the loads applied to the wedge member.

Accordingly, the variability of the pressing forces toward the cylinder portion outer peripheral surfaces by the pressing members acquiring the wedge actions from the wedge members receiving the pressing loads can be reduced, thereby being able to improve the accuracies in the inverse deformations added to the cylinder bores by the finish processing.

In the processing method of the present invention, fluid pressures are used as the loads (the pressing loads), and the load applying means includes fluid pressure transmitting members provided to be biased toward the pressing direction of the wedge members from the side of the opening portions by the fluid pressures. In this embodiment, the fluid pressures are transmitted to the wedge members via the fluid pressure transmitting members for applying the loads to the wedge members, and the fluid pressures are adjusted for equalizing the loads applied to the wedge members.

In the processing method of the present invention, the finish processing is a honing process, using a structure comprising a head portion, having a horning stone and moving to the cylinder bore for acting the honing stone on the cylinder bore, and a guide portion, being close to and separated from the cylinder head mounting surface for guiding the head portion. The guide portion includes a hydraulic chamber for slidably supporting the fluid pressure transmitting members in a given direction containing the pressing direction and for acting the fluid pressures on the fluid pressure transmitting members.

Accordingly, the existing constructions used for the honing process for the cylinder bore can be utilized, so as to support the fluid pressure transmitting members and add the hydraulic pressures to the fluid pressure transmitting members, without the need for providing additional constructions so as to support the fluid pressure transmitting members or the like, thereby being able to simplify the device configuration and improve the workability.

In the processing method of the present invention, the wedge members are minutely vibrated, namely microscopic vibrations are caused to the wedge members.

Accordingly, when the pressing members are removed from the bottom portions of the water jacket by the rising of the fluid pressure transmitting members, the pressing members are easy to be removed. The friction coefficients $\mu$ between the pressing members and the forming faces of the water jacket become stable, on condition that the cylinder portion outer peripheral surfaces are pressed by the pressing members due to the pressing of the wedge members, so that the variability in the pressing forces toward the cylinder portion outer peripheral surfaces by the pressing members can be more effectively reduced.

In the processing method of the present invention, a pin member having an outer diameter being capable of inserting to the water jacket from the side of the opening toward the cylinder head mounting surface is provided, and the pin member is pressed and inserted to a bottom of the water jacket, in contacting an outer periphery of the pin member to the portion of the periphery of the cylinder portion, thereby pressing the portion of the periphery of the cylinder portion.

Accordingly, during the finish processing for the cylinder bore of the cylinder block, the deformation in the direction opposite to the bore deformations caused at the time of actual working of the engine to the cylinder bores after the finish processing can be added, without leading to the complexity of the working process and the increase in cost, which are caused by using the jig for processing such as the dummy head, as well as the deteriorations in the circularity of the cylinder bores at the time of actual working of the engine can be restrained.

In the processing method of the present invention, the pin member has lower conductivity than a body of the cylinder block, and between the outer periphery of the inserted pin member and an outer surface of the water jacket, a clearance exists not to contact the outer periphery of the pin member with the outer surface of the water jacket when a thermal expansion occurs in a working internal-combustion engine provided with the cylinder block.

Accordingly, the bore deformations caused at the actual working of the internal combustion engine (at the actual working of the engine) can be restrained, so as to prevent the deteriorations in the circularity of the cylinder bores at the actual working of the engine.

In accordance with the second aspect of the present invention, provided a jig for a finish processing for a cylinder bore of a cylinder block, the cylinder block including a cylinder bore, having a cylindrical opening for slidably incorporating a piston, provided on a cylinder head mounting surface for fixing a cylinder head by fastening members, and including a water jacket, formed as a wall surrounding the cylinder bore via a cylinder portion. The jig includes a pressing member having a wedge surface containing pressing portions separatably connected with each other and a wedge member engaging to the wedge surface for adding the wedge action. In the jig, the separating direction includes the pressing direction for the portion of the periphery of the cylinder portion, and in the state where the wedge action is added from an opening portion of the water jacket toward the cylinder head mounting surface, the pressing member is engaged to the wedge member where the pressing members are inserted into the water jacket, the pressing member is pressed from a side of the opening portion for gaining the wedge action, thereby pressing the portion of the periphery of the cylinder portion.

Accordingly, during the finish processing for the cylinder bore of the cylinder block, the deformation in the direction opposite to the bore deformations caused at the time of actual working of the engine to the cylinder bores after the finish processing can be added, without leading to the complexity of the working process and the increase in cost, which are caused by using the jig for processing such as the dummy head, as well as the deteriorations in the circularity of the cylinder bores at the time of actual working of the engine can be restrained.

The jig of the present invention further includes a plurality of the wedge members, engaged to each of the pressing members inserted for adding the wedge action to the portions of the periphery of the cylinder portion corresponding to the fastened portions and a connecting member for connecting the wedge in disposing at a position corresponding to that of the inserted pressing members. In the jig, the pressing members are supported with the corresponding wedge members being capable of engaging.

Accordingly, during the finish processing for the cylinder bores, the pressing members can be easily inserted into the water jacket, thereby being able to advance the workability of the finish processing for the cylinder bores and to improve the productivity of the cylinder block.

In the alternative embodiment, the jig of the present invention further includes a plurality of the wedge members, engaged to each of the pressing members inserted for adding the wedge action to the portions of the periphery of the cylinder portion corresponding to the fastened portions and load applying means for applying loads (pressing loads) to each of the wedge members engaged to each of the pressing members inserted for adding the wedge action to the portions of the periphery of the cylinder portion corresponding to the fastened portions, for pressing the wedge members from the side of the opening portions. In the jig, the load applying means equalizes the loads applied to the wedge member Accordingly, the variability of the pressing forces toward the cylinder portion outer peripheral surfaces by the pressing members acquiring the wedge actions from the wedge members receiving the pressing loads can be reduced, thereby being able to improve the accuracies in the inverse deformations added to the cylinder bores by the finish processing.

In the jig of the present invention, fluid pressures are used as the loads and the load applying means includes a fluid pressure transmitting member fluid pressure transmitting members provided to be biased toward the pressing direction of the wedge members from the side of the opening portions by the fluid pressures and a hydraulic chamber forming member for forming a hydraulic chamber, slidably supporting the fluid pressure transmitting member in a given direction containing the pressing direction and for acting the fluid pressures on the fluid pressure transmitting member. In the jig, the fluid pressures in the hydraulic chamber are adjusted for equalizing the loads applied to the wedge members.

In the jig of the present invention, the load applying means changes the loads in apulsatile fashion for causing the microvibrations to the wedge members.

Accordingly, when the pressing members are removed from the water jacket bottom portions by the rising of the fluid pressure transmitting members, the pressing members are easy to be removed. The friction coefficient μ between the pressing members and the forming faces of the water jacket is stable, on the condition that the cylinder portion outer peripheral surfaces are pressed by the pressing members due to the pressing of the wedge members, so that the variability of the pressing forces toward the cylinder portion outer peripheral surfaces by the pressing members can be more effectively reduced.

In accordance with the third aspect of the present invention, provided a cylinder block having the inserted pin members.

Accordingly, in the internal combustion engine made up of the above-mentioned cylinder block, with regard to the bore deformation, the heat deformation caused at the time of actual working of the engine can be also prevented, in addition of the prevention of the assembly deformation caused during the assembly of the cylinder heads.

DETAILED DESCRIPTION OF THE INVENTION

Figure 1:
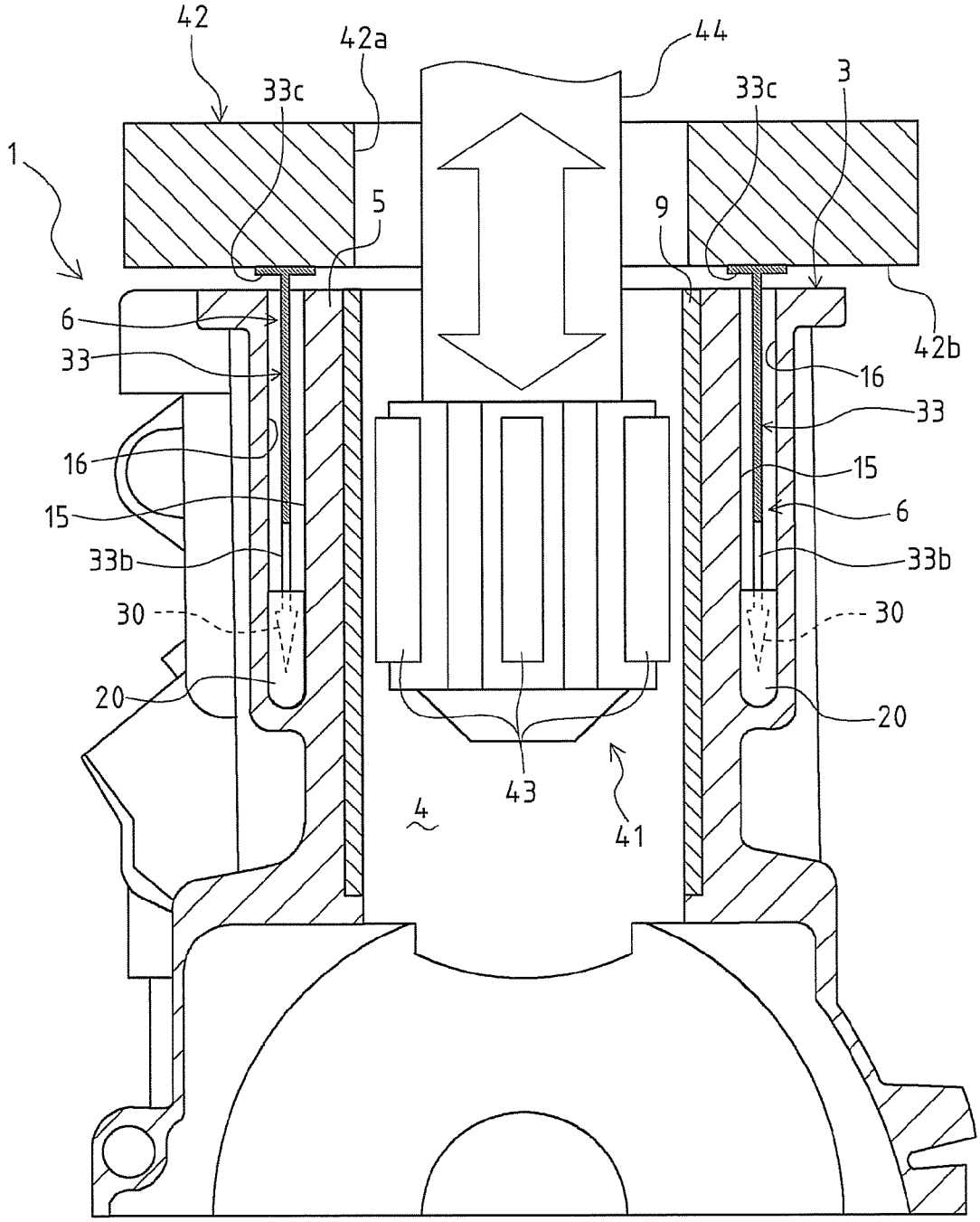
FIG. 1 is a cross-sectional view of constructions of a cylinder block and the like according to the first embodiment of the present invention.

A cylinder block as a processing object for a processing method according to the present invention comprises an internal-combustion engine such as an automobile engine, and it includes a cylinder bore and a water jacket. The cylinder bore is a cylindrical bore portion that is open on a cylinder head mounting surface into which a cylinder head is fixed by a fastening member (a head bolt) and that slidably incorporates a piston. The water jacket is formed so as to surround the cylinder bore via a cylinder portion as a wall portion surrounding the cylinder bore, and is open on the cylinder head mounting surface.

During the finish processing for the cylinder bore so as to acquire the given circularity of the cylinder bore, the present invention relatively heightens the rigidity toward a pressure from the cylinder bore side, at the portion of a phase (a bolt phase) corresponding to a fastening portion by the head bolt, compared to the other portion of the phase, so as to increase the machining allowance (the grinding allowance) due to the processing for the portion of the bolt phase in the cylinder bore, in the cylinder portion as the wall portion surrounding the cylinder bore, and adds a deformation in the direction opposite to the bore deformation (an inverse deformation) at the time of actual working of the engine to the cylinder bore, in a single part state after the finish processing for the cylinder bore. Accordingly, the deterioration in the circularity of the cylinder bore at the time of actual working of the engine is restrained.

Specifically, with regard to the cylinder block in the condition that the cylinder bore has achieved the prescribed circularity by receiving the finish processing such as the honing process, the cylinder head is assembled into the cylinder head mounting surface thereof by the bolt fastening. Accordingly, periphery of the bolt strongly pressed on the cylinder block has a larger deformation, and the assembly deformation that the portion of the bolt phase dwindles inward is caused in the cylinder bore, thereby deteriorating the circularity. In the bore deformation caused due to the heat load at the time of actual working of the engine, the assembly deformation becomes the emphasized one. In this respect, during the finish processing for the cylinder bore as mentioned above, the rigidity toward a pressure from the cylinder bore side, at the portion of the bolt phase in the cylinder portion is relatively heightened compared to the other portion of the phase, and the machining allowance by the finish processing is increased, thereby being able to adding the inverse deformation to the cylinder bore in the single part state after the finish processing. The cylinder head is assembled into the cylinder block in the condition that the inverse deformation is added to the cylinder bore, thereby causing the assembly deformation to the cylinder bore inversely deformed. The deformation due to the heat load is caused to the cylinder bore inversely deformed, at the time of actual working of the engine. Consequently, the cylinder bore becomes the perfect circle at the time of actual working of the engine, thereby improving the circularity of the cylinder bore at the time of actual working of the engine.

Hereinafter, explanation will be given on the respective embodiments of the present invention, wherein the rigidity toward a pressure from the cylinder bore side at the portion of the bolt phase is heightened, compared to the other portion of the phase, during the finish processing for the cylinder bore, in the cylinder portion.

The first embodiment of the present invention will be described, with reference to FIGS. 1 to 4.

Figure 2:
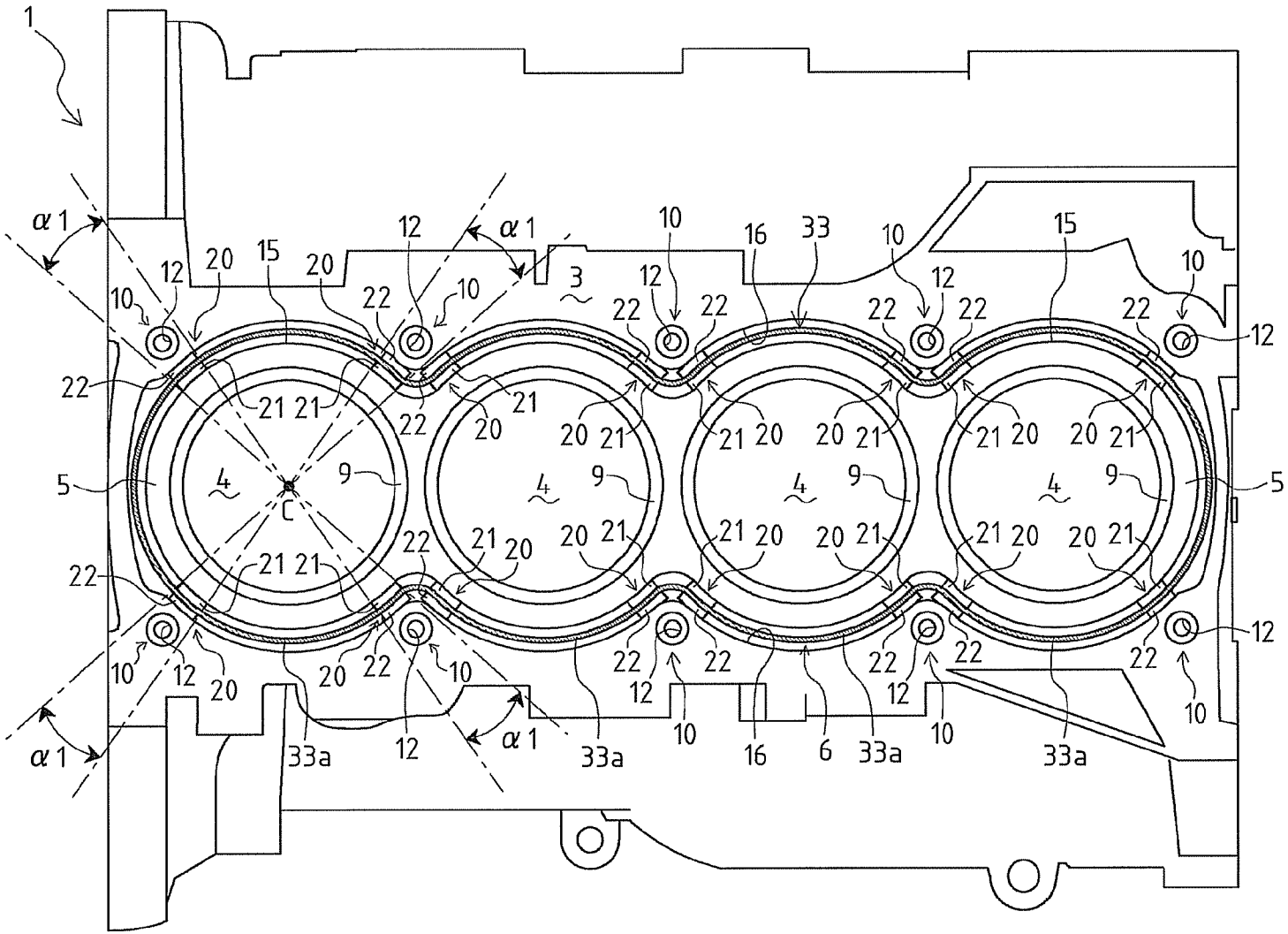
FIG. 2 is a plane view of the cylinder block according to the first embodiment of the present invention.

As shown in FIGS. 1 to 2, a cylinder block 1 according to the present embodiment constructs the body thereof of aluminum, and has a cylinder head mounting surface (hereinafter, referred to as "a head mounting surface") 3, into which a cylinder head (not shown) fixed by a fastening member (a head bolt), a cylinder bore 4, as a cylindrical bore portion, which is open on the cylinder head mounting surface 3 and slidably incorporates a piston (not shown), as well as a water jacket 6, which is formed so as to surround the cylinder bore 4 via a cylinder portion 5 as a wall portion surrounding the cylinder bore 4 and is open on the cylinder head mounting surface 3.

As shown in FIG. 2, the cylinder block 1 according to the present embodiment makes up a in-line four-cylinder engine equipped with an automobile or the like, and includes four cylinder bores 4, which they are arranged side-by-side in line so that the central axis directions thereof are parallel to each other.

The head mounting surface 3 is a sealing surface formed as a planar surface on one side of the cylinder block 1, and the cylinder head is assembled into the head mounting surface 3 via a gasket or the like. The head bolt (not shown) is used in the assembly of the cylinder head into the head mounting surface 3. Specifically, as shown in FIG. 2, the head bolt penetrates the cylinder head and threaded into the bolt hole 12 as a female threaded portion provided with the cylinder block 1, so that the cylinder head is tightly fastened onto the cylinder block 1.

A bolt fastening portion 10 as a fastening portion used for fixing of the cylinder head into the cylinder block 1, i.e., the bolt holes 12 are provided on the periphery of the cylinder bores 4 in the head mounting surfaces 3. As shown in FIG. 2, in the present embodiment, four bolt holes 12 are provided at approximately equal spaces on the periphery of the respective cylinder bores 4. Two bolt holes 12 are shared between the adjacent cylinder bores 4. In other words, in the cylinder block 1 making up the in-line four-cylinder engine as the present embodiment, a total of ten bolt holes 12 are provided for four cylinder bores in line.

Oil pans (not shown) are fitted with the opposite side of the head mounting surfaces 3 of the cylinder block 1. Hereinafter, in the cylinder block 1, the side into which the cylinder head is assembled is defined as "the upper side", and the opposite side thereof defined as "the lower side".

Four cylinder bores 4 are disposed so that the center axis directions thereof are the vertical ones and arranged in line as described above. The piston rings are attached to the pistons incorporated into the cylinder bores 4, and the pistons are vertically slidably reciprocated 4 via the piston rings into the cylinder bores 4.

The upper spaces above the pistons into the respective cylinder bores 4 comprises a part of a combustion chamber so as to combust the mixture of fuel and air. The cylinder bores 4 are formed on a cylindrical surface having the prescribed circularity, by the finish processing such as the honing process, so as to maintain the air tightness of the fuel-air mixture or the gas generated due to the combustion. Briefly, at the time of actual working of the engine produced using the cylinder block 1, the piston are slidably reciprocated due to the explosion and combustion of the fuel-air mixture in the combustion chamber, thereby rotating a crank shaft (an input shaft) connected via the piston and a con rod (a connecting rod).

The cylinder bores 4 are formed so that a cylinder liners 9 cylindrically constructed of casting iron are incorporated into the inner peripheral surface side of the cylinder portion 5 approximately cylindrically formed in accordance with the respective cylinder bores 4 of the cylinder block 1, by casting, pressing into or the like. Briefly, the inner peripheral surfaces of the cylinder liners 9 form the cylinder bores 4 and become sliding surfaces.

Incidentally, in the present embodiment, the cylinder bores 4 are formed using the cylinder liner 9, but for example, when the cylinder block are comprised of iron materials such as casting iron, the cylinder bores may be directly formed onto the structure of the cylinder block.

The water jacket 6 is a passageway for cooling water, and formed so as to surround four cylinder bores 4 in the casting of the cylinder block 1. The water jacket 6 is provided via the cylinder portions 5 around the cylinder bores 4.

The cylinder portion 5 is a cylindrical wall portion formed so as to surround the cylinder bores 4 on the periphery of the cylinder bores 4, i.e., on the periphery of the cylinder liners 9, and, as shown in FIG. 2, the cylindrical portions are connected between the adjacent cylinder bores 4.

Briefly, the water jacket 6 is formed so that it is open on the side of the head mounting surface 3, by the outer peripheral surface of the cylinder portion 5 (the inner side surface of the water jacket 6) and the outer peripheral wall surface (the outer side surface of the water jacket 6) formed so as to face with it. In other words, the cylinder block 1 of the present embodiment has an open deck typed structure that the water jacket 6 is open on the side of the head mounting surface 3. The cylinder bores 4 or the like are cooled through the water jacket 6 via the cylinder portion 5.

In the cylinder block 1 of the present embodiment equipped with the above-mentioned construction, during the finish processing for the cylinder bores 4, the rigidity toward a pressure from the cylinder bore 4 side at the portion of the bolt phase is relatively heightened compared to the other portion of the phase, in the cylinder portion 5.

Specifically, in the after-mentioned processing method for the cylinder block 1, the rigidity toward a pressure from the cylinder bore 4 side at the pressed portion in the cylinder portion 5 is heightened compared to the other portion, by pressing the portions of the phase corresponding to the fastening portions by the head bolts (the bolt fastening portions 10) in the circular forms of the cylinder bores 4, out of the outer peripheral surface of the cylinder portion 5 (hereinafter, referred to as "a cylinder portion outer peripheral surface") 15 forming the inner side surface of the water jacket 6, so that the finish processing for the cylinder bores 4 is performed.

Figure 3:
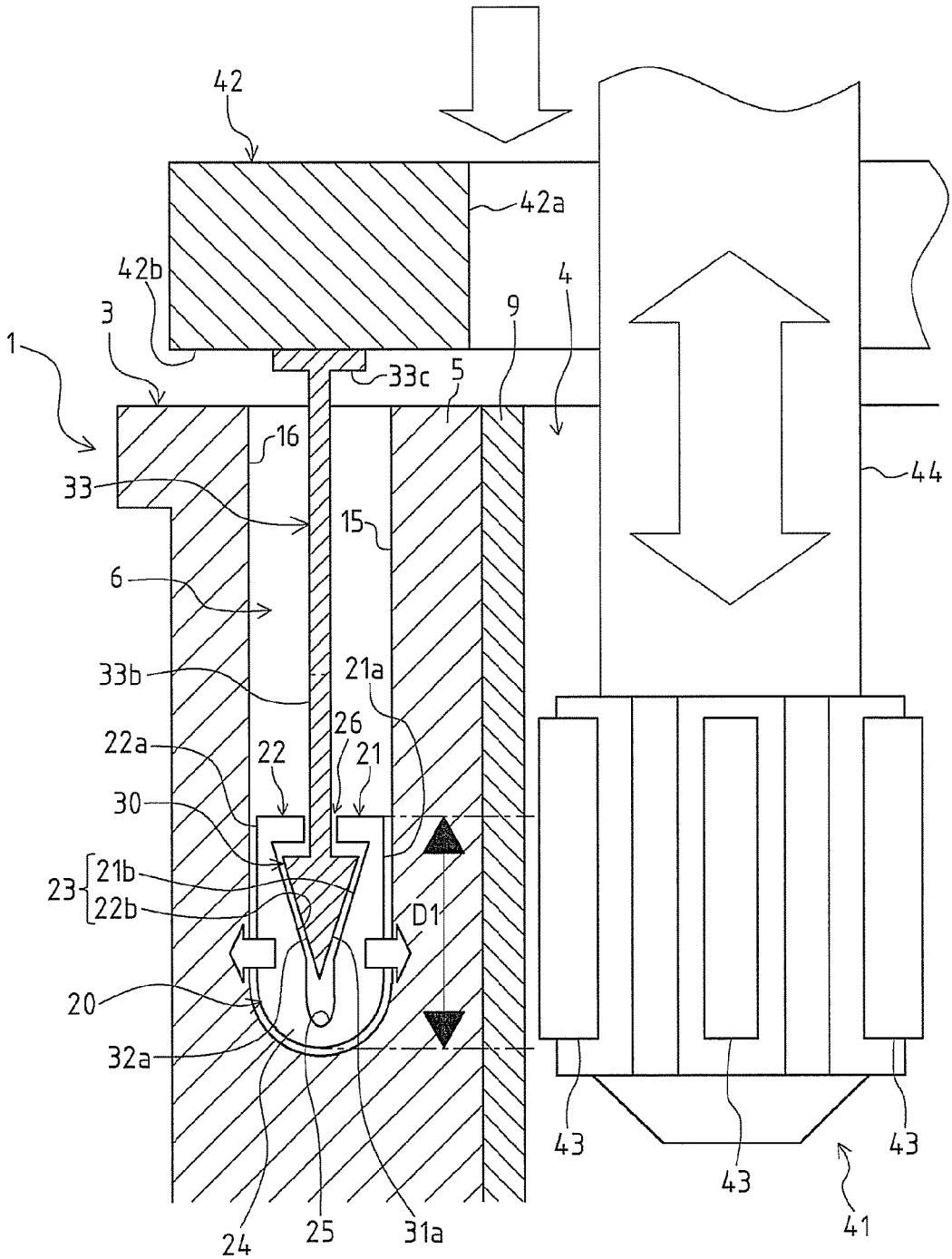
FIG. 3 is a cross-sectional view of constructions of a pressing top and a wedge body.

In the processing method for the cylinder block 1 according to the present embodiment, as shown in FIGS. 1 to 3, pressing tops 20 as pressing members having wedge surfaces 23 which have pressing portions 21, 22 connected disengageable to each other and receive the wedge action in the direction the pressing portions 21, 22 are disengaged therebetween, and wedge bodies 30 as wedge members engaging the wedge surfaces 23 so as to add the wedge action are used, so as to press on the portions of the bolt phase on the cylinder portion outer peripheral surface 15.

The portion of the bolt phase on the cylinder portion outer peripheral surface 15 is pressed, by pressing from the jacket opening portion side on the pressing top 20 inserted into the portion of the bolt phase on the water jacket 6 and engaged with the wedge body 30, in the condition that the directions that the pressing portions 21, 22 are disengaged include the pressing direction on the portion of the bolt phase in the cylinder portion outer peripheral surface 15 and that the wedge action can be achieved by pressing from the opening portion side of the water jacket 6 on the head mounting surface 3 (the upper side, hereinafter, referred to as "the jacket opening portion side".

The pressing tops 20 are constructed so that they have the rigidity of the extent of pressing on the cylinder portion 5 of the cylinder block 1. Therefore, while the body of the cylinder block 1 is made up of the aluminum, the pressing tops 20 are made up of, for example, the iron material, so that the pressing tops 20 have higher rigidity than the body of the cylinder block 1.

As shown in FIG. 3, the pressing tops 20 have the pressing portions 21, 22 connected disengageable to each other. Both of the pressing portions 21, 22 are formed as plate portions, one end sides of which are connected to a connected portion 24, with facing to each other.

The pressing portions 21, 22, one end sides of which are connected to the connected portion 24, are constructed so as to be disengaged from each other, due to the elastic deformation of the connected portion 24. In other words, the pressing tops 20 are constructed so as to expand from the other end sides of the pressing portions 21, 22 (the opposite side of the connected portion 24, hereinafter, referred to as "the opening side"). The given portions of the cylinder portion outer peripheral surface 15 are pressed by the expansion of the pressing tops 20.

The pressing tops 20 have shapes/sizes that can be inserted into the water jacket 6, and are inserted into the water jacket 6 from the side of the connected portion 24 (with the connected portion 24 side being as the end side). The pressing tops 20, which are inserted into the water jacket 6, become approximately tangent (have slightly spaces) on the outer peripheral surface thereof to the forming face of the water jacket 6.

Therefore, the pressing tops 20 have curved forms which the pressing portions 21, 22 are along with the wall surfaces forming the water jacket 6, and totally have forms along with the shape of the water jacket 6, due to the shape along with one of the bottom of the water jacket 6.

As described above, the pressing tops 20 are constructed so that the pressing portions 21, 22 thereof are disengaged from each other so as to expand from the opening side thereof, and are inserted into the water jacket 6 so that the expanding direction thereof (the disengaging direction thereof) includes the pressing direction toward the cylinder portion outer peripheral surface 15. Specifically, in the pressing tops 20, which is inserted into the water jacket 6, one of pressing portion 21 is located on the inside of the water jacket 6, while the other of pressing portion 22 is located on the outside of the water jacket 6. Thus, the pressing tops 20 are inserted into the water jacket 6, so that the outer peripheral surface 21*a* of the pressing portion 21 inside (hereinafter, also, referred to as "the inside pressing portion 21") faces with (is approximately tangent to) the cylinder portion outer peripheral surface 15, and the outer peripheral surface 22*a* of the pressing portion 22 outside (hereinafter, also, referred to as "the outside pressing portion 22") corresponds to (is approximately tangent to) the outside face of the water jacket 6 (hereinafter, referred to as "the jacket outside face").

Accordingly, the expanding direction of the pressing tops 20 (the direction disengaging the inside pressing portion 21 from the outside pressing portion 22 includes the pressing direction toward the cylinder portion outer peripheral surface 15. In other words, when the pressing tops 20 in the water jacket 6 expand (the inside pressing portion 21 disengage the outside pressing portion 22), the jacket outside face 16 is pressed by (the outer peripheral surface 22*a* of) the outside pressing portion 22, and the cylinder portion outer peripheral surface 15 is pressed by (the outer peripheral surface 21*a* of) the inside pressing portion 21.

When the pressing tops 20 receive the wedge action in the direction that the pressing portions 21 and 22 are disengaged via the wedge surface 23, they are inserted into the water jacket 6, on the condition of receiving the wedge action (hereinafter, referred to as "the insertion condition").

The pressing tops 20 acquire the wedge action by pressing on the wedge body 30 with engagement (wedge engagement) to the wedge surface 23 from the opening side. That is to say, the wedge surface 23 in the pressing tops 20 are formed between the inside pressing portion 21 and the outside pressing portion 22, and are approximately V-shaped surfaces tapered toward the connected portion 24. Specifically, the wedge surface 23 are formed in the approximately V-formation, by a slope 21*b* formed on the side of the outside pressing portion 22 in the inside pressing portion 21 and a slope 22*b* formed on the side of the inside pressing portion 21 in the outside pressing portion 22.

The wedge bodies 30 engage the wedge surfaces 23 of the pressing tops 20. The wedge bodies 30 have V-formation corresponding to the approximately V-formation of the wedge surfaces 23, by the first slope 31*a* corresponding to the slope 21*b* of the inside pressing portion 21 and the second slope 32*a* corresponding to the slope 22*b* of the outside pressing portion 22, and engage the pressing tops 20, by contacting the respective slopes 31*a*, 32*a* with the slopes 21*b*, 22*b* of the pressing tops 20, respectively. The pressing tops 20 acquire the wedge action by pressing on the wedge bodies 30 with engagement to the pressing tops 20 from the opening side of the pressing tops 20. The given portions of the cylinder portion outer peripheral surface 15 are pressed due to this wedge action.

In other words, the wedge action acquired by the pressing tops 20 means the action that the pressing tops 20 expand from the opening side thereof (the inside pressing portion 21 and the outside pressing portion 22 are disengaged), and the given portions of the cylinder portion outer peripheral surface 15 are pressed due to this action.

In this way, the pressing tops 20 are inserted into the water jacket 6, as the insertion condition, so that the opening side thereof becomes the jacket opening portion side.

In this regard, the lower sides (the side of the connected portion 24) of the wedge surfaces 23 on the pressing tops 20 is provided therein with a recessed portion 25 so as to allow the expansion of the pressing tops 20 (the disengagement of the inside pressing portion 21 and the outside pressing portion 22), i.e., the movement of the wedge body 30 with the pressing of the wedge body 30.

A slippage protecting mechanisms so as to prevent the pressing tops 20 with engagement to the wedge body 30 from moving along the shape of the water jacket 6 are occasionally provided, between the pressing tops 20 and the wedge body 30.

The suppress strengths toward the cylinder portion outer peripheral surface 15 by the pressing tops 20 are controlled by the degree of the angles of the wedge surfaces 23, the largeness of the pressing forces for the wedge body 30 or the like.

The pressing due to the wedge action acquired by the pressing tops 20 toward the cylinder portion outer peripheral surface 15 as mentioned before is performed toward the portion of the bolt phase on the cylinder portion outer peripheral surface 15. In other words, the pressing tops 20 are inserted into the positions corresponding to the portion of the bolt phase of the cylinder portion outer peripheral surface 15 on the water jacket 6 and the outer peripheral surface 21*a* of the inside pressing portion 21 contacting the cylinder portion outer peripheral surface 15 has a largeness (an area) corresponding to the portion of the bolt phase of the cylinder portion outer peripheral surface 15.

In this respect, the bolt phase means the phase corresponding to the bolt fastening portion 10 in the circular shape (for the circular shape) of the cylinder bore 4, and the "phase" in the circular shape of the cylinder bore 4 is as follows. That is to say, the cylinder bore 4 as a cylindrical bore portion is a circular shape in the central axis directional vision. The angle in a circle centered on the position of the central axis is determined, in the circular shape (for the circular shape) of the cylinder bore 4. The angle (the angular range) is defined as "the phase" in the circular shape of the cylinder bore 4.

Therefore, as shown in the leftmost cylinder bore 4 in FIG. 2, the bolt phase becomes the prescribed angular range al of the direction including from the center (the position C) to the bolt fastening portion 10 and adjacent portions thereof, for the angle in a circle centered on the position C of the central axis, in the central axis directional vision that the cylinder bore 4 is considered as the circular shape. As the present embodiment, in the construction that four bolt fastening portions 10 are provided at approximately equal spaces on the periphery of the cylinder bores 4, four phases (four angular ranges $\alpha$1) corresponding to the bolt fastening portions 10 as described above are present at the respective cylinder bores 4.

Hereinafter, with respect to the bolt phase, the rest of the phases (another phases) are referred to as "non-bolt phase".

With respect to the pressed portion toward the cylinder portion outer peripheral surface 15 by the pressing tops 20, the height (the length in the vertical direction) range thereof is equivalent to the height (the length in the vertical direction) of the pressing tops 20 inserted into the water jacket 6. In this regard, the range between arrows shown as the referential mark D1 in FIG. 3 is equivalent to the height of the pressing tops 20, which becomes the portion where the outer peripheral surface 21*a* of the inside pressing portion 21 contacts the cylinder portion outer peripheral surface 15. The portion where the outer peripheral surface 21*a* of the inside pressing portion 21 contacts the cylinder portion outer peripheral surface 15 becomes the height range of the pressed portion toward the cylinder portion outer peripheral surface 15 by the pressing tops 20.

Incidentally, the height range of the pressed portion toward the cylinder portion outer peripheral surface 15 by the pressing tops 20, i.e., the height of the pressing tops 20 is occasionally set up in accordance with the shape of the cylinder block 1 or the like.

As seen from the above, the given portion pressed by the pressing tops 20, which is the portion with which the outer peripheral surface 21*a* of the inside pressing portion 21 contacts, in the cylinder portion outer peripheral surface 15, is the portion of the bolt phase (see the angular range $\alpha$1), and is the portion of the height range equivalent to the height (see the referential mark D1) of the pressing tops 20 inserted into the water jacket 6.

The portion in the cylinder portion outer peripheral surface 15 pressed by the pressing tops 20 becomes the portion where the rigidity toward a pressure from the cylinder bore 4 side is heightened.

As can be seen, in the processing method for the cylinder block 1 according to the present embodiment, the portion of the bolt phase in the cylinder portion outer peripheral surface 15 is pressed, using the pressing tops 20 and the wedge body 30, the finish processing for the cylinder bore 4 is performed, in the condition that the rigidity toward a pressure from the cylinder bore 4 side at the above-mentioned pressed portion in the cylinder portion 5 is heightened, compared to the other portion.

Accordingly, in the finish processing for the cylinder bore 4 in the cylinder block 1, the deformation in the direction opposite to the bore deformation caused at the time of actual working of the engine can be added to the cylinder bore 4 after the finish processing, without leading to the complexity of the working process and the increase in cost caused by using the jig for processing such as the dummy head, thereby restraining the deterioration of the circularity of the cylinder bore 4 at the time of actual working of the engine.

The finish processing for the cylinder bore 4 is performed, in the condition that the rigidity of the cylinder portion 5 toward a pressure from the cylinder bore 4 side at the pressed portion is heightened, by pressing the portion of the bolt phase on the cylinder portion outer peripheral surface 15, thereby increasing the surface pressure toward the pressure from the cylinder bore 4 side accompanying the processing (for example, the surface pressure (the pressing load) from the grinding stone during the honing process), at the portion of the bolt phase as the pressed portion, and increasing the machining allowance (the grinding allowance) due to the processing for wall surface forming the cylinder bore 4.

In other words, the surface pressure toward the pressure from the cylinder bore 4 side accompanying the processing is decreased in the portion of the non-bolt phase that the rigidity is not increased, so as to be in the condition of elastically deforming and escaping from the pressure, thereby decreasing the machining allowance. On the other hand, the portion of the bolt phase that the rigidity is increased by the pressing from the cylinder portion outer peripheral surface 15 side is prevented from elastically deforming and escaping from the pressure from the cylinder bore 4 side accompanying the processing, thereby increasing the machining allowance by the processing.

Figure 13:
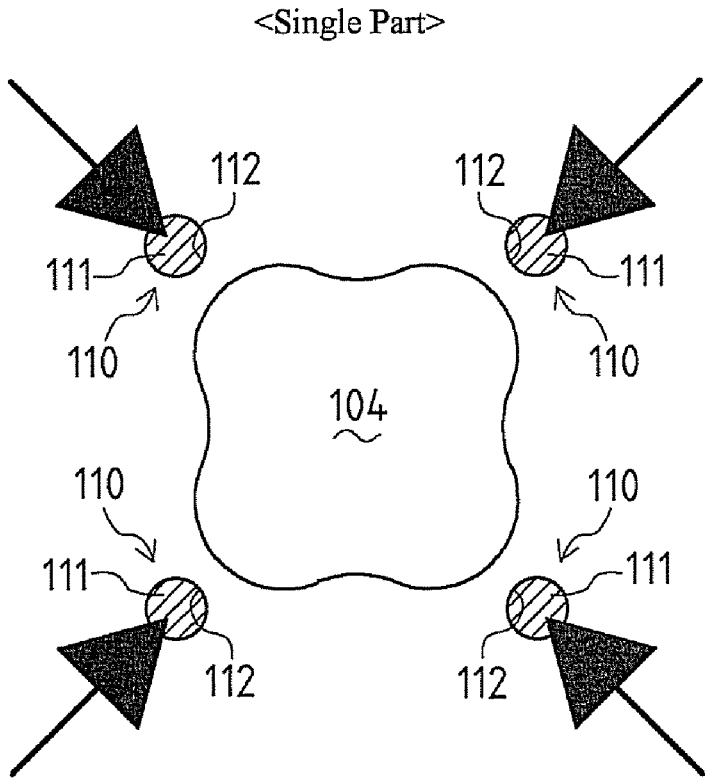
FIG. 13 is a pattern diagram showing an inverse deformation of the cylinder bore.

Consequently, the inverse deformation, by which the portion of the bolt phase that has been pressed by the pressing tops 20 is expanded, is caused, in the cylinder block 1 after the processing (see the cylinder bore 104 in FIG. 13).

The cylinder head is assembled into the cylinder block 1 which the inverse deformation is caused to the cylinder bore 4 by the bolt fastening, and the heat load at the time of actual working of the engine is added to the cylinder block 1, thereby being able to form the cylinder bore 4 as the perfect circle by the bore deformation at the time of actual working of the engine. Briefly, the deterioration of the circularity in the cylinder bore 4 at the time of actual working of the engine can be restrained.

Therefore, with respect to the above-mentioned given angular range $\alpha$1 of the bolt phase, the width of the angle thereof is not especially limited, but the area is set up as the angular range corresponding to the portion dwindling inward due to the bolt axial force or the heat stress heat by the fastening of the head bolt onto the cylinder bore 4, during the assembly deformation in assembling the cylinder head and the bore deformation at the time of actual working of the engine.

As described above, in the cylinder block 1 of the present embodiment, four bolt fastening portions 10 (bolt holes 12) are provided at approximately equal spaces on the periphery of one cylinder bore 4. Meanwhile, the pressing tops 20 are inserted into the water jacket 6 and arranged, at the portion of the bolt phase corresponding to the respective bolt fastening portions 10. When the finish processing for one cylinder bore 4 is performed, four pressing tops 20 disposed on the periphery of the cylinder bore 4 as at least the processing object need to be pressed by the wedge body 30. In other words, the rigidity at the portions of four bolt phases are increased by the pressing force from the side of the cylinder portion outer peripheral surface 15, thereby being able to cause the inverse deformation to the cylinder bore 4.

In this respect, as the present embodiment, in the processing method for the cylinder block 1 using the pressing tops 20 and the wedge body 30, a plurality of wedge bodies 30, which are engaged to each of the pressing tops 20 inserted on the insertion condition into the portion of the bolt phase on the water jacket 6 corresponding to each of the plurality of bolt fastening portions 10, are integrally connected on the configuration states corresponding to those of the inserted pressing tops 20.

As shown in FIG. 2, in the present embodiment, the cylinder block 1 has ten bolt fastening portions 10, and a total of ten pressing tops 20 are arranged at the portions of the bolt phases corresponding to these bole fastening portions 10. Ten wedge bodies 30 engaged to the ten pressing tops 20 are integrally connected on the configuration state of the pressing tops 20 inserted on the insertion condition.

A connecting ring 33 as a connecting member is used for connecting the wedge bodies 30. The connecting ring 33 is constituted as an integral member that integrally connects ten wedge bodies 30, and has a shape along that of the water jacket 6.

Specifically, when the wedge bodies 30 are pressed and acted on the pressing tops 20 from the side of the jacket opening portion, the connecting rings 33 which integrally connect the wedge bodies 30 become the configuration that can be inserted into the water jacket 6 from the side of the jacket opening portion (the side of the head mounting surface 3).

Therefore, as shown in FIG. 2, the connecting rings 33 in the present embodiment have four cylindrical portions 33*a* corresponding to the respective cylinder bores 4, along the water jacket 6 formed so as to surround four cylinder bores 4 in the cylinder block 1. The connecting rings 33 also have one closed configuration that the cylindrical portions 33*a* corresponding to the adjacent cylinder bores 4 are connected to each other.

The wedge bodies 30 are connected via the rod portions 33*b* to the lower end side of the connection ring 33 having the above-mentioned configuration (the end side of the direction inserting into the water jacket 6). Specifically, the connecting ring 33, which is inserted in to the water jacket 6, are provided at the position corresponding to the configuration state of ten pressing tops 20 with the rod portions 33*b*, and the wedge bodies 30 is connected to the lower end side of the rod portions 33*b*.

Incidentally, the integral connection configuration of the wedge bodies 30 by the connecting ring 33 is not limited to the present embodiment.

For example, as the integral connection configuration of the wedge bodies 30 by the connecting rings 33, the wedge bodies 30 may be constructed as a part of a circularity so that the cross-sectional shapes in the radial direction thereof becomes a V-shaped configuration corresponding to the wedge surfaces 23 of the pressing tops 20, as well as the wedge bodies 30 having the configuration as the part of the circularity and the connecting rings 33 may be one closed configuration that the cylindrical portions totally connect to each other, i.e., the configuration that the respective cylindrical portions 33*a* comprising the connecting ring 33 is projected from one side of the cylindrical axial direction and the wedge bodies 30 are formed on the projected portion thereof.

The wedge bodies 30 integrally connected via the connecting ring 33 are engageably supported on the corresponding portions of the pressing tops 20.

As shown in FIG. 3, on the condition that the wedge bodies 30 are supported by the pressing tops 20, the wedge bodies 30 connected to the end portion of the rod portions 33*b* by the connecting rings 33 are interposed between the inside pressing portion 21 and the outside pressing portion 22 in the pressing tops 20. On the condition that the wedge bodies 30 are supported onto the pressing tops 20, the wedge bodies 30 become engageable to the pressing tops 20. Specifically, the engageable condition on the wedge bodies 30 means the condition that the wedge bodies 30 are interposed between the inside pressing portion 21 and the outside pressing portion 22, the first slope 31*a* of the wedge bodies 30 is opposed to the slope 21*b* of the inside pressing portion 21 and the second slope 32*a* of the wedge bodies 30 is opposed to the slope 22*b* of the outside pressing portion 22, respectively, so that the wedge bodies 30 is pressed toward the pressing tops 20 so as to be engageable to it.

The pressing tops 20 supported on the wedge bodies 30 are locked on the wedge bodies 30 connected by the connecting ring 33.

In other words, on the opening side of the pressing tops 20, the spaces 26, which control the wedge bodies 30 to escape from the opening side thereof and which allow the wedge bodies 30 to connect the rod portions 33*b*, are provided between the inside pressing portion 21 and the outside pressing portion 22. The pressing tops 20 are locked on the wedge bodies 30 connected by the connecting rings 33, due to the spaces 26.

In this regard, the respective pressing tops 20 supported on the wedge bodies 30 connected by the connecting ring 33 are supported so that the direction where the pressing portions 21, 22 are disengaged to each other includes the pressing direction toward the portions of the bolt phases on the cylinder portion outer peripheral surface 15, with all pressing tops 20 inserted into the water jacket 6 at the respective disposed positions.

As described above, in the present embodiment, ten pressing tops 20 inserted into the portions of the respective bolt phases on the water jacket 6 are supported on each of ten wedge bodies 30 integrally connected via the connecting ring 33, whereby all of them are assembled.

The configurations that include the pressing tops 20 and the wedge bodies 30 on the assembled condition are inserted so that the respective pressing tops 20 are located at the portions of the bolt phases on the water jacket 6, on the inserted condition of which, the connecting rings 33 is pressed downward (on the side of the pressing tops 20), so that the plurality of wedge bodies 30 are pressed from the side of the jacket opening portion, by interlocking the plurality of wedge bodies 30.

Thus, the wedge bodies 30 corresponding to the plurality of pressing tops 20 are integrally connected, and the pressing tops 20 are supported onto the respective wedge bodies 30, whereby all pressing tops 20 located at the given position on the water jacket 6 are assembled together with the wedge bodies 30 corresponding to the respective pressing tops 20. Accordingly, during the finish processing for the cylinder bores 4, the pressing tops 20 can be easily inserted into the water jacket 6, thereby being able to advance the workability of the finish processing for the cylinder bores 4 and to improve the productivity of the cylinder block 1.

As mentioned above, in the present embodiment, the jig for processing the cylinder block 1 for use in the finish processing for the cylinder bores 4 has the inside pressing portion 21 and the outside pressing portion 22 connected disengageable to each other. The jig for processing also has the pressing tops 20 having the wedge surfaces 23 receiving the wedge actions in the direction where the pressing portions 21, 22 are disengaged to each other, and the wedge bodies 30 that engage the wedge surfaces 23 so as to add the wedge actions to them. With respect to the jig for processing, the direction where the pressing portions 21, 22 are disengaged to each other includes the pressing direction toward the portions of the bolt phases on the cylinder portion outer peripheral surfaces 15, with the wedge bodies 30 engaged onto the pressing tops 20 inserted into the portions of the bolt phases on the water jacket 6, on the insertion condition, so that the jigs for processing press on the portions of the bolt phases on the cylinder portion outer peripheral surfaces 15, so as to be pressed from the side of the jacket opening portion and acquire the wedge actions.

The jig for processing the cylinder block 1 according to the present embodiment comprises the plurality of wedge bodies 30, which engage each of the pressing tops 20 inserted on the insertion condition into the portions of the bolt phases on the water jacket 6, corresponding to each of the plurality of bolt fastening portions 10, and comprises the connecting ring 33 which integrally connect the plurality of wedge bodies 30, on the configuration states corresponding to the inserted pressing tops 20. The jigs for processing are constructed so that the pressing tops 20 are supported onto the corresponding wedge bodies 30, with the wedge bodies 30 engageable.

Meanwhile, in the present embodiment, the honing process so as to obtain the prescribed circularity of the cylinder bores 4 is performed as the finish processing for the cylinder bores 4.

Specifically, in the processing method for the cylinder block 1 according to the present embodiment, the finish processing for the cylinder bores 4 is the honing process performed using the construction comprising a hone head (also, referred to as "a honing head") 41 and a hone guide 42. The hone head 41 has a grinding stone 43 for the honing and moves to the cylinder bore 4 so as to function as a head portion acting the grinding stone 43 on the cylinder bore 4. The hone guide 42 is provided so that it can come close to and discharge from the head mounting surface 3 and functions as a guide portion so as to guide the hone head 41.

The honing process is performed with the honing processing unit. The unit comprises the honing means consisting of the hone head 41 and the hone guide 42. The grinding against the wall surface forming the cylinder bore 4 is performed, using the honing means.

The hone head 41, as a whole, is approximately cylindrically constructed, and has the grinding stones 43 on the outer peripheral surface portion thereof. The hone head 41 is constructed on the end portion (the lower portion) of a principal axis 44 that can vertically (axially) move and rotate around the shaft center as a rotation axis by a driving means (not shown). In other words, the hone head 41 is provides so that it can vertically (axially) move and rotate via the principal axis 44.

The grinding stones 43 provided with the hone head 41 are circularly provided at equal spaces, for example, in the circumferential direction on the outer peripheral surface portion of the hone head 41.

The grinding stones 43 are constructed, for example, in the hone head 41. The grinding stones 43 are constructed so that they can displace radially outward due to the tapered action by a tapered surface or the like, by using a known mechanism comprising the tapered surface for converting the axial movement of the rod member coaxially provided with the principal axis 44 into the radial one of the grinding stone 43. Briefly, during the honing process for the cylinder bore 4, the grinding stones 43 are pressed and engaged on the wall surface of the cylinder bore 4 by being displaced radially outward, and they act on the wall surface of the cylinder bore 4 in keeping with the rotational movement of the hone head 41 or the like.

The hone guide 42 is a component so as to position the hone head 41 to the cylinder bore 4 or the like. The hone guide 42 has a guide bore 42*a* for allowing the vertical movement of the hone head 41 including the principal axis 44 or the like, so as to guide the vertical movement or the like of the hone head 41 to the cylinder bore 4.

The hone guide 42 is provided so that it can move in the direction coming close to and disengaging from the head mounting surface 3 of the cylinder block 1, i.e., in the vertical direction.

During the honing process, the hone head 41 is guided by the hone guide 42 located at the given position with respect to the cylinder bore 4, and the wall surface of the cylinder bore 4 receives the grinding process by the grinding stone 43, based on the rotational movement of the hone head 41 or the like.

Briefly, during the honing process, the hone guide 42 is stopped at the prescribed position in the direction coming close to and disengaging from the head mounting surface 3, i.e., the hone guide 42 is at the prescribed distance from the head mounting surface 3, and the hone head 41 is guided by the hone guide 42 in such a condition.

When the honing process is performed using the above-mentioned construction, the following method is utilized, so as to press toward the portions of the bolt phases on the cylinder portion outer peripheral surface 15 by pressing the wedge bodies 30 on the pressing tops 20.

Specifically, the wedge bodies 30 are connected to the hone guide 42, and the wedge bodies 30 are pressed from the side of the jacket opening portion by coming close to the hone guide 42 toward the head mounting surface 3.

The construction so as to connect the wedge bodies 30 to the hone guide 42 is not particularly limited, but as mentioned before, in the present embodiment that the plurality of (ten, in the present embodiment) wedge bodies 30 are integrally connected by the connecting ring 33, the connecting ring 33 is attached to the hone guide 42, so that the wedge bodies 30 are connected to the hone guide 42.

The method for attaching the connecting rings 33 to the hone guides 42 is not particularly limited, but, for example, as shown in FIGS. 1 and 3, a flange portion 33*c* is formed at the upper end portion of the connecting ring 33 (the end portion opposed to the wedge bodies 30), the connecting ring 33 is attached to the hone guide 42 via the flange portion 33*c*. In other words, the flange portion 33*c* is fixed on the block side surface 42*b* as the surface opposed to the head mounting surface 3 of the cylinder block 1 (the lower side surface) in the hone guide 42 by the bolt fastening or the like, so that the connecting rings 33 is attached to the hone guide 42.

Thus, the wedge bodies 30 are pressed from the side of the jacket opening portion, by connecting the wedge bodies 30 to the hone guide 42 and by coming close to the hone guide 42 toward the head mounting surface 3.

Therefore, the length of the connecting ring 33 in the vertical direction are set up so that the wedge bodies 30 are pressed, by adding the pressing tops 20 to the wedge actions so as to acquire the prescribed pressing forces toward the cylinder portion outer peripheral surfaces 15, on the condition that the hone guide 42 is located at the given position in the directions coming close to and disengaging from the head mounting surface 3, where they are stopped during the honing process.

As seen from the above, existing constructions and their operations for the honing process during pressing the wedge bodies 30 toward the pressing tops 20 can be used, by connecting the wedge bodies 30 to the hone guide 42 as the construction so as to perform the honing process that is the finish processing for the cylinder bores 4 and by using the operation of the hone guide 42 for pressing the wedge bodies 30 toward the pressing tops 20, without the need for additional construction for pressing the wedge bodies 30, thereby simplifying the device configuration and improving the workability.

Incidentally, in the present embodiment, the operation of the hone guide 42 is used for pressing the wedge bodies 30 toward the pressing tops 20, but the additional configuration for pressing the wedge bodies 30 may be provided without the operation of the hone guide 42, which may be used as a means for pressing the wedge bodies 30 toward the pressing tops 20.

Specifically, a load applying means for applying the load so as to press the wedge bodies 30 from the side of the jacket opening portion may be provided differently from the honing means for the finish processing for the cylinder bores 4, so as to apply the load to the wedge bodies 30 by a hydraulic pressure, motor driving force or the like.

Figure 4:
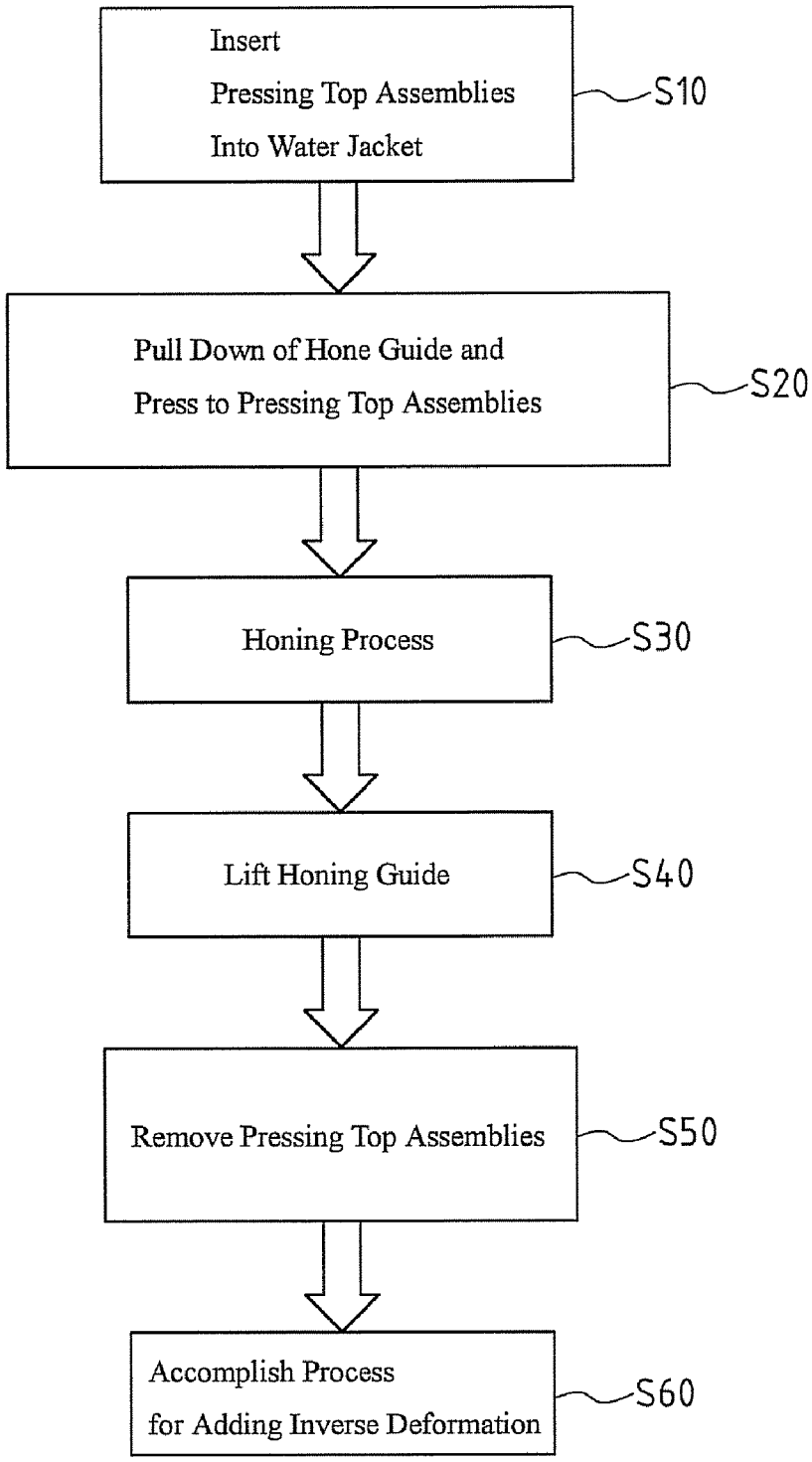
FIG. 4 is a flow diagram showing a processing flow of the cylinder block according to the first embodiment of the present invention.

A processing flowchart for the processing method of the cylinder block 1 in the present embodiment as mentioned above will be described using a flow diagram as shown in FIG. 4. Incidentally, hereinafter, the configurations that are in the assembling condition, including the wedge bodies 30 connected by the connecting ring 33 and the respective pressing tops 20 supported on each of the wedge bodies 30, are defined as "the pressing tops assemblies"

First, the pressing tops assemblies are inserted into the water jacket 6 (Step (hereinafter, abbreviated as "S") 10). Briefly, the respective pressing tops 20 in the pressing tops assemblies are inserted into the portions of the respective bolt phases on the water jacket 6, before the honing process for the cylinder bores 4.

Next, the pressing tops assemblies are pressed, by pulling down the hone guide 42 (S 20). In other words, the respective wedge bodies 30 are pressed via the connecting ring 33 from the side of the jacket opening portion, accompanying the lowering of the hone guide 42 so as to add the respective pressing tops 20 to the wedge actions.

Accordingly, the portions of the bolt phases on the cylinder portion outer peripheral surfaces 15 are pressed, thereby relatively increasing the rigidities of the portions of the cylinder portion 5 corresponding to the pressed portions toward the pressure from the side of the cylinder bore 4.

The honing process for the cylinder bore 4 is performed, on the condition that the rigidities of the portions of the bolt phases in the cylinder portion 5 toward the pressure from the side of the cylinder bore 4 are increased (S 30). That is to say, the hone head 41 accompanying the guide by the hone guide 42 is inserted into the cylinder bore 4, and the grinding process is performed by acting the grinding stones 43 on the wall surface of the cylinder bore 4 due to the rotational movement thereof or the like.

On this occasion, as the rigidities toward the surface pressure from the grinding stones 43 as the pressure from the side of the cylinder bore 4 are increased at the portions of the bolt phases on the cylinder portion 5, due to the pressing from the pressing tops 20, the surface pressure of the grinding stones 43 on the wall surfaces of the cylinder bore 4 thereof are relatively increased compared to that of another portions, thereby increasing the machining allowance (the grinding allowance) caused by the honing process. Consequently, the inverse deformations are caused to the cylinder bores 4.

After finishing the honing process, the hone guide 42 is lifted (S 40). Specifically, after the hone head 41 is lifted and removed from the inside of the cylinder bore 4, the hone guide 42 is moved toward the direction disengaging from the head mounting surfaces 3 of the cylinder block 1.

Then, the pressing tops assembly is removed from the hone guide 42 when necessary (S 50).

Accordingly, as soon as the honing process for the cylinder bore 4 is accomplished, the process for adding the inverse deformation to the cylinder bore 4 is finished (S 60).

The second embodiment of the present invention will be described with reference to FIGS. 5 and 6. Incidentally, in the respective embodiments as described below, the descriptions in common with the above-mentioned first embodiment will be arbitrarily omitted with reference to the same marks or the like.

In the processing method for the cylinder block 1 according to the present embodiment, load applying means are provided, wherein they apply the loads (hereinafter, referred to as "the pressing loads") so as to press the wedge bodies 30 from the side of the jacket opening portions to each of the plurality of wedge bodies 30, which engage the respective pressing tops 20 inserted on the insertion condition into the portions of the bolt phases on the water jacket 6, corresponding to each of the plurality of bolt fastening portions 10. Briefly, in the present embodiment, the means for applying the loads so as to add the wedge actions to the pressing tops 20 are independently provided on each of the wedge bodies 30 engaged to the pressing tops 20 inserted into the potions of the respective bolt phases on the cylinder block 1.

The pressing loads applied to the plurality of wedge bodies 30 by the load applying means are equalized.

In the present embodiment, the hydraulic pressure as an example of the fluid pressure is used, as the pressing load. That is to say, as shown in FIG. 5, the loads applying means according to the present embodiment includes a piston rod 71 as a fluid pressure transmitting member provided with the wedge bodies 30 so as to be biased toward the direction pressing it from at least the side of the jacket opening portions (hereinafter, simply referred to as "the pressing direction") by the hydraulic pressure.

The hydraulic pressure is transmitted to the wedge bodies 30 via the piston rod 71, so that the pressing loads are applied to the wedge bodies 30 and the pressing loads applied to plurality of wedge bodies 30 are equalized by the adjustment of the hydraulic pressure.

Figure 5:
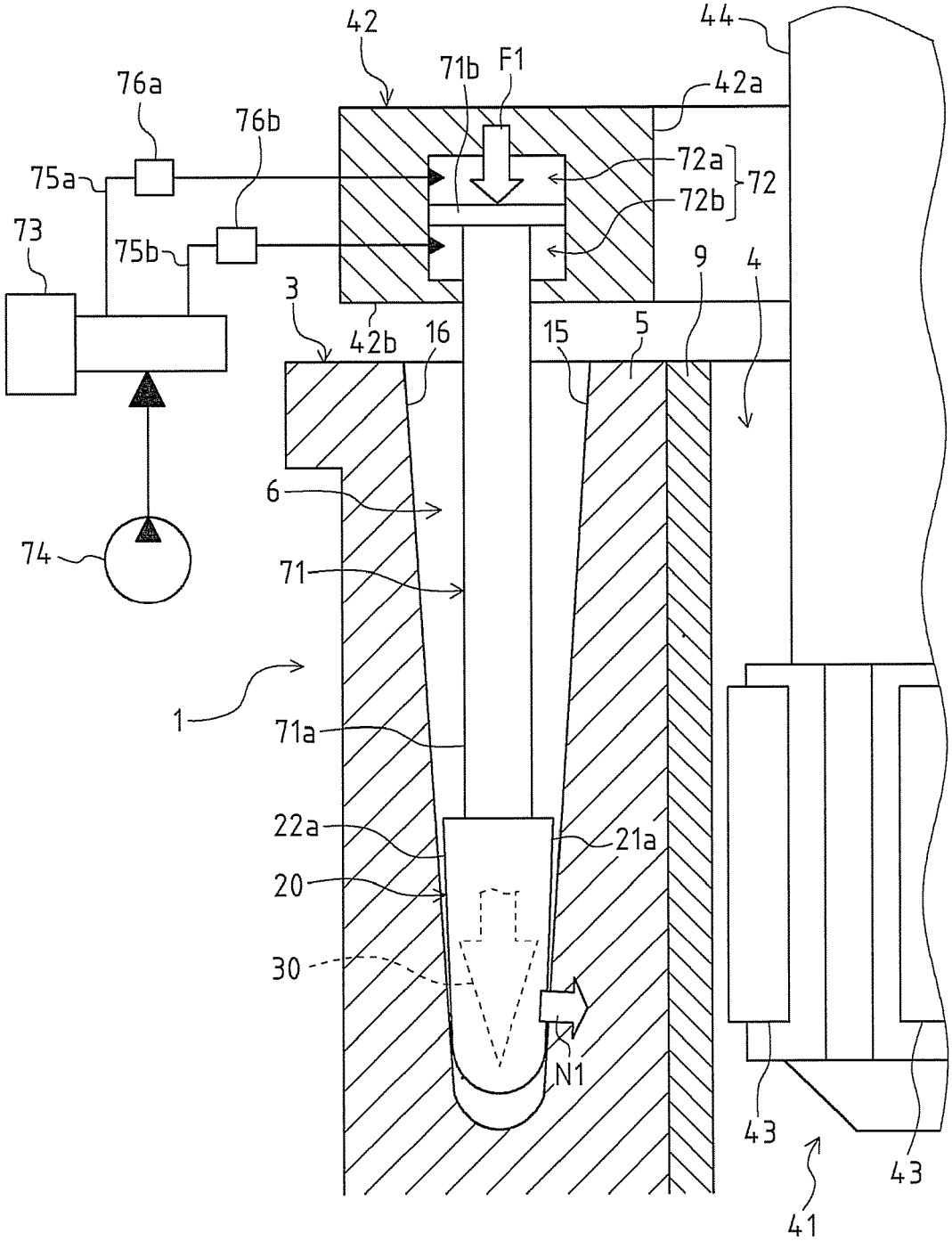
FIG. 5 is a diagram of constructions of a jig for processing and the like according to the second embodiment of the present invention.

As shown in FIG. 5, the piston rod 71 is totally an approximately rod member, as well as it has a rod portion 71*a* as a rod portion having the diameter that can be inserted into the water jacket 6 and a piston portion 71*b* provided on one end portion (the upper end portion) of the rod portion 71*a*, so as to be the diameter-expansion portion to the rod portion 71*a*. The piston rod 71 is incorporated on one end side thereof into a hydraulic chamber 72 and vertically slidably supported thereon, whereby it is provided so as to be biased at least downward by the hydraulic pressure as mentioned above. Briefly, the piston portion 71*b* in the piston rod 71 becomes a tap portion having the slidable configuration to the side wall surface forming the hydraulic chamber 72. In this way, the hydraulic chamber 72 movably supports the piston rod 71 in the given sliding direction including the pressing direction (the vertical direction), and functions as the fluid-pressure chamber exerting the hydraulic pressure on the piston rod 71.

The piston rod 71 transmits the hydraulic pressure received in the hydraulic chamber 72 to the wedge bodies 30 as the pressing loads. In other words, the piston rod 71 is integrally or separately (connectedly) provided on the other end portion (the lower end portion) of the rod portion 71*a* with the wedge bodies 30. The pressing tops 20 are supported on the wedge bodies 30. The piston rod 71 receives the hydraulic pressure via the piston portion 71*b* in the hydraulic chamber 72 so as to be biased downward (see an arrow F1), thereby applying the pressing loads to the wedge bodies 30 and adding the pressing tops 20 engaged to the wedge bodies 30 to the wedge actions. The prescribe portions on the cylinder portion outer peripheral surfaces 15 are pressed by the pressing tops 20 which have acquired the wedge actions (see an arrow N1).

In other words, the pressing tops 20 inserted into the portions of the bolt phases on the water jacket 6 receive the wedge actions from the wedge bodies 30 that have received the hydraulic pressure in the hydraulic chamber 72 as the pressing loads via the piston rod 71, so that the inside pressing portions 21 and the outside pressing portions 22 are disengaged to each other (see FIG. 3). Accordingly, the jacket outside surfaces 16 are pressed by the outer peripheral surfaces 22*a* of the outer pressing portions 22, and the cylinder portion outer peripheral surfaces 15 are pressed by the outer peripheral surfaces 21*a* of the inside pressing portions 21 (see the arrow N1).

As seen from the above, in the present embodiment, a hydraulic cylinder mechanism is comprised of the piston rod 71 and the hydraulic chamber 72, as the loads applying means for applying the pressing loads to the wedge bodies 30. The hydraulic cylinder mechanism comprised of the piston rod 71 and the hydraulic chamber 72 are provided for each of the wedge bodies 30 engaged to the pressing tops 20 inserted into the portions of the bolt phases on the cylinder block 1. Therefore, in the present embodiment that ten portions of the bolt phases on the cylinder block 1 are provided, ten hydraulic cylinder mechanisms are provided as the loads applying means for the respective wedge bodies 30.

The pressing loads applied to the respective wedge bodies 30 by the above-described hydraulic cylinder mechanisms are equalized with regard to all wedge bodies 30. In other words, the hydraulic pressure in the hydraulic chambers 72 are adjusted, so that the hydraulic pressure (see the arrow F1) added to the piston rod 71 during applying the pressing loads to the wedge bodies 30 is constant in all hydraulic chambers 72.

In the present embodiment, the following configuration is utilized for adjusting the hydraulic pressure in the hydraulic chamber 72. In the hydraulic cylinder mechanism comprised of the piston rod 71 and the hydraulic chamber 72, the rod portion 71*a* of the piston rod 71 is constructed as a hemi-rod type double-acting cylinder projecting from one side (the lower side) of the hydraulic chamber 72. Specifically, the upper and lower two hydraulic chambers 72*a*, 72*b* are formed via the piston portion 71*b* of the piston rod 71, in the hydraulic chamber 72, and gateways for the oils are provided at the respective hydraulic chambers 72*a*, 72*b*. The gateways for the oils at the respective hydraulic chambers 72*a*, 72*b* become the inlet or the outlet for the oils by changing over the circuit, thereby vertically reciprocating (moving downward and upward) the piston rod 71.

Therefore, when the pressure oil is applied to the hydraulic chamber 72*a* above the piston portion 71*b* in the hydraulic chamber 72, the piston rod 71 is moved downward (biased in the pressing direction), thereby applying the pressing loads to the wedge bodies 30. Meanwhile, when the pressure oil is applied to the hydraulic chamber 72*b* below the piston portion 71*b* in the hydraulic chamber 72, the piston rod 71 is moved upward (biased in the direction opposed to the pressing direction). In the following description, the hydraulic chamber 72*a* above the piston portion 71*b* in which the piston rod 71 is moved downward by the supply of the pressure oil is defined as "the downward hydraulic chamber 72*a*", and the hydraulic chamber 72*b* below the piston portion 71*b* in which the piston rod 71 is moved upward by the supply of the pressure oil is defined as "the upward hydraulic chamber 72*b*".

A solenoid changeover valve 73 is utilized for changing over the supply of the pressure oils (changing over the circuit) to the downward hydraulic chamber 72*a* and the upward hydraulic chamber 72*b*. The solenoid changeover valve 73 is constructed as so-called the solenoid operating changeover valve, as well as it has a solenoid (an electric magnet) operated via a relay by the prescribed control signal (an electric signal) and a spool operated by the power of the solenoid, thereby changing over the flow passage in the hydraulic circuit by the operation of the spool or the like. Briefly, the solenoid changeover valve 73 is constituted as a valve operating mechanism called the OCV (the oil control valve). The supplies of the pressure oils to the downward hydraulic chamber 72*a* and the upward hydraulic chamber 72*b* are adjusted (the flow passage is changed over and the oil quantity is adjusted), due to the solenoid changeover valve 73, so that the hydraulic pressure in the respective downward hydraulic chamber 72*a* and the upward hydraulic chamber 72*b* are increased or decreased.

In other words, the oils in the oil tank (not shown) are supplied to the hydraulic chamber 72 by a hydraulic pump 74, and the supplies of the pressure oils to the downward hydraulic chamber 72*a* and the upward hydraulic chamber 72*b* in the hydraulic chamber 72 are adjusted by the solenoid changeover valve 73 interposed between the hydraulic pump 74 and the hydraulic chamber 72. Specifically, the solenoid changeover valve 73 includes a port receiving the supply of the oils by the hydraulic pump 74, a port connected to the downward hydraulic chamber 72*a*, a port connected to the upward hydraulic chamber 72*b* and the other port for a drain. The port receiving the supply of the oils by the hydraulic pump 74 is connected to the oil tank via the hydraulic pump 74. The port connected to the downward hydraulic chamber 72*a* is connected to the gateway of the oils in the downward hydraulic chamber 72*a* via an oil passage (hereinafter, referred to as "the first oil passage") 75*a*, and the port connected to the upward hydraulic chamber 72*b* is connected to the gateway of the oils in the upward hydraulic chamber 72*b* via an oil passage (hereinafter, referred to as "the second oil passage") 75*b*.

In the above-mentioned hydraulic circuit configuration, at least the following two conditions are included as the circuit conditions that can be changed over by the solenoid changeover valve 73. One is the condition that the oils supplied by the hydraulic pump 74 are supplied from the first oil passage 75*a* via the solenoid changeover valve 73 into the downward hydraulic chamber 72*a*, and that the oils in the upward hydraulic chamber 72*b* is discharged from the second oil passage 75*b* via the solenoid changeover valve 73 (the first condition). The other is the condition that the oils supplied by the hydraulic pump 74 are supplied from the second oil passage 75*b* via the solenoid changeover valve 73 into upward hydraulic chamber 72*b*, and the oils in the downward hydraulic chamber 72*a* is discharged from the first oil passage 75*a* via the solenoid changeover valve 73 (the second condition). In this regard, on the first condition, the piston rod 71 is moved downward, and on the second condition, the piston rod 71 is moved upward.

Hydraulic sensors 76*a*, 76*b* are provided for each of the downward hydraulic chamber 72*a* and the upward hydraulic chamber 72*b*. In the present embodiment, the hydraulic sensor 76*a* for detecting the hydraulic pressure of the downward hydraulic chamber 72*a* is provided on the first oil passage 75*a*, and the hydraulic sensor 76*b* for detecting the hydraulic pressure of the upward hydraulic chamber 72*b* is provided on the second oil passage 75*b*.

Due to the above-described hydraulic circuit configuration, the hydraulic pressures in the hydraulic chamber 72 are adjusted so that the pressing loads applied to the wedge bodies 30 are equalized. Specifically, the command (the control signal) is issued to the solenoid changeover valve 73, so that the hydraulic pressures added to the piston rod 71 for applying the pressing loads to the wedge bodies 30 are constant in all hydraulic chambers 72, based on the detection values on the hydraulic pressures of the downward hydraulic chamber 72*a* and the upward hydraulic chamber 72*b* detected by the respective hydraulic sensors 76*a*, 76*b*, thereby controlling the solenoid changeover valve 73. The supplies of the pressure oils to the downward hydraulic chamber 72*a* and the upward hydraulic chamber 72*b*, i.e., the pressing loads transmitted from the hydraulic chambers 72 via the piston rod 71 to the wedge bodies 30 are controlled, by the solenoid changeover valve 73 controlled in this way.

In order to adjust the supplies of the pressure oils to the downward hydraulic chamber 72*a* and the upward hydraulic chamber 72*b* (control the pressing loads), for example, feed back controls are performed based on the detection values by the hydraulic sensors 76*a*, 76*b*. That is to say, in the feed back control, the hydraulic pressures in the hydraulic chambers 72, as the pressing loads applied to the wedge bodies 30 via the piston rod 71, become controlled objects. On the hydraulic pressures in the hydraulic chambers 72 as these controlled objects, a constant (common) value on all hydraulic chambers 72 is preliminary set up as a target value. The target value set up herein corresponds to the pressing loads toward the wedge bodies 30, which causes the desired magnitude of the inverse deformation added by the finish processing for the cylinder bore 4, i.e., the desired one of the pressing forces (see the arrow N1) toward the cylinder portion outer peripheral surfaces 15 by the pressing tops 20.

The input signals (the reference input signals) based on the target value are compared with the detection signals (the feed back signals) based on the detection values by the hydraulic sensors 76*a*, 76*b*, and the signal based on the difference between them is transmitted as the control signal to the solenoid changeover valve 73 as the operating portion for the controlled object, thereby controlling the working volume in the solenoid changeover valve 73 (the operating volume of the spool). The pressing loads applied to all wedge bodies 30 are equalized, due to the feed back control like this.

In the present embodiment, as remarked above, the honing process using the construction having the hone head 41 and the hone guide 42 is performed, as the finish process for the cylinder bores 4. Thus, in the present embodiment, as shown in FIG. 5, the hydraulic chamber 72, which supports the piston rod 71 and exerts the hydraulic pressure on the piston rod 71 is provided in the hone guide 42.

In other words, in the present embodiment, the hydraulic chamber 72 making up the hydraulic cylinder mechanism together with the piston rod 71 are provided in the hone guide 42 comprising the honing means for performing the honing process for the cylinder bore 4. Specifically, in the hone guide 42 located at the given position to the cylinder bore 4 during the honing process as described previously, the hydraulic chamber 72 is provided at the position where the piston rod 71 supporting thereof corresponds to the wedge body 30 engaged to the pressing top 20 inserted into the water jacket 6. In other words, the hydraulic chamber 72 provided in the hone guide 42 used for the honing process is provided at the position corresponding to the portions of the bolt phases on planar view, in the hone guide 42.

Thus, the hydraulic chamber 72 making up the hydraulic cylinder mechanism so as to apply the pressing load to the wedge body 30 are provided in the hone guides 42 used for the honing process for the cylinder bore 4, so that the existing constructions used for the honing process for the cylinder bore 4 can be utilized, so as to support the piston rod 71 and add the hydraulic pressures to it, without the need for providing additional constructions so as to support the piston rods 71 or the like, thereby being able to simplify the device configuration and improve the workability.

Incidentally, in the present embodiment, the hydraulic chamber 72 so as to support the piston rod 71 or the like is provided in the hone guide 42 as the existing construction, but the hydraulic chamber 72 is not limited to the configuration. In fact, the hydraulic chamber 72 may be provided at the configuration different from the hone guide 42.

As seen from the above, in the present embodiment, the jig for processing the cylinder block 1 for used in the finish processing for the cylinder bore 4 comprises a plurality of wedge bodies 30, engaging each of the pressing tops 20 inserted on the insertion condition into the portions of the bolt phases on the water jacket 6, corresponding to each of the plurality of bolt fastening portions 10, and comprises the loads applying means for applying the pressing loads, for each of the plurality of wedge bodies 30

The jig for the processing according to the present embodiment is constituted so that the pressing loads applied to the plurality of wedge bodies 30 by the loads applying means are equalized.

In the present embodiment, the loads applying means applies the pressing loads to the wedge bodies 30 by the hydraulic pressures (the hydraulic cylinder mechanisms), as well as it includes the piston rod 71 and the fluid pressure chamber forming member forming the hydraulic chamber 72. In this regard, in the present embodiment, the hone guide 42 is utilized as the fluid pressure chamber forming member making up the hydraulic cylinder mechanisms. In other words, in the present embodiment, as described above, the hydraulic chamber 72 making up the hydraulic cylinder mechanism is provided in the hone guide 42 comprising the honing means. Therefore, alternative member different from the hone guide 42 may be used as the fluid pressure chamber forming member making up the hydraulic cylinder mechanism.

In the present embodiment, the loads applying means equalizes the pressing loads added to the plurality of wedge bodies 30 by adjusting the hydraulic pressure in the hydraulic chamber 72.

In the present embodiment, the solenoid changeover valves 73, the hydraulic sensor 76*a*, 76*b* are provided, as the constructions that the pressing loads applied to the wedge bodies 30 are equalized. Briefly, as mentioned before, in order to equalize the pressing loads added to the wedge bodies 30, for example, the feed back controls based on the detection values by the hydraulic sensors 76*a*, 76*b* are performed, thereby controlling the solenoid changeover valves 73 and adjusting the supplies of the pressure oils to the downward hydraulic chambers 72*a* and the upward hydraulic chambers 72*b* (controlling the pressing loads).

As the present embodiment, the loads applying means applying the pressing loads to the wedge bodies 30 are provided for the respective wedge bodies 30, and the pressing loads applied to the wedge bodies 30 by the respective load applying means during the finish processing for the cylinder bores 4 are equalized on all wedge bodies 30, thereby reducing the variability of the pressing forces toward the cylinder portion outer peripheral surfaces 15 by the pressing tops 20 acquiring the wedge actions from the wedge bodies 30 receiving the pressing loads so as to improve the accuracies in the inverse deformations added to the cylinder bores 4 by the finish processing.

More specifically, when multipoint on the cylinder portion outer peripheral surfaces 15 (four points per one cylinder bore 4 in the present embodiment) are pressed by the pressing tops 20 during the finish processing for the cylinder bores 4, the pressing forces toward the cylinder portion outer peripheral surfaces 15 by the pressing tops 20 may be variable, due to the variability in the bottom configuration or the like of the water jacket 6 and the like, depending on the pressed positions. In this case, the deformation volumes (the grinding volumes by the finish processing) of the cylinder bores 4 vary according to the pressed positions by the pressing tops 20, so that the desired deformations (the inverse deformations) could be formed on the cylinder bores 4. Unless the desired deformations could be formed on the cylinder bores 4, the circularity of the cylinder bores 4 at the time of actual working of the engine could be deteriorated, contrary to the intentions. The deterioration in the circularity of the cylinder bores 4 at the time of actual working of the engine leads to that of the fuel consumptions.

In this regard, as the present embodiment, the pressing loads applied to all wedge bodies 30 are equalized, thereby reducing the pressing forces toward the cylinder portion outer peripheral surfaces 15 by the pressing tops 20, so as to be able to improve the accuracies in the desired deformations added to the cylinder bores 4, when causing the inverse deformations to the cylinder bores 4 by the finish processing.

Incidentally, the hydraulic circuit configurations provided in the hydraulic chambers 72, so as to equalize the pressing loads applied to the wedge bodies 30 are not particularly limited to the present embodiments. Briefly, as the hydraulic circuit configurations provided in the hydraulic chambers 72, as far as they could equalize the pressing loads applied to the wedge bodies 30 via the piston rods 71, the constructions of the valve operating mechanisms so as to change over the circuits for the downward hydraulic chambers 72*a* and the upward hydraulic chambers 72*b* or the like, the positions at which the hydraulic sensors are provided or the like are not limited to the present embodiment, but a variety of circuit configurations can be applied.

In the present embodiment, as the fluid pressures that are the pressing loads applied to the wedge bodies 30 by the load applying means, the hydraulic pressures are utilized, but another fluid pressures such as the air pressures may be used. For example, when the air pressures are used as the fluid pressures that are the pressing loads applied to the wedge bodies 30, an air cylinder mechanism may be comprised as the loads applying means including the piston rods 71.

Due to the above-mentioned constructions, the finish processing for the cylinder bores 4 in the present embodiment is performed as follows. First, the hone guides 42 supporting the piston rods 71 at the hydraulic chambers 72 thereof insert the piston rods 71 supporting thereof into the water jacket 6 of the cylinder block 1 and move downward up to the given height positions of the head mounting surfaces 3, thereby being positioned at the given positions to the cylinder bores 4. In this regard, in the piston rods 71, as described above, the rod portions 71*a* are provided on the side of the distal end portions (the lower end portions) thereof with the wedge bodies 30, and the pressing tops 20 are engaged to and supported on the wedge bodies 30.

Next, the wedge bodies 30 are pressed by the piston rods 71. Specifically, the pressure oils supplied from the hydraulic pumps 74 is introduced from the solenoid changeover valves 73 via the first oil passages 75*a* to the downward hydraulic chambers 72*a* (the circuit condition is in the first condition), and the piston rods 71 are biased toward the pressed directions, thereby applying the pressing loads to the wedge bodies 30. Accordingly, the pressing tops 20 engaged to the wedge bodies 30 acquire the wedge actions so as to press the portions of the bolt phases on the cylinder portion outer peripheral surfaces 15. On the parts of the cylinder portions 5 corresponding to the pressed portions on the cylinder portion outer peripheral surfaces 15, the rigidities toward the pressures from the sides of cylinder bores 4 are relatively increased compared with the other portions. In this respect, the pressing loads applied to the wedge bodies 30 are controlled so that they are equalized on all of the wedge bodies 30, as described above.

The honing process for the cylinder bores 4 is performed, on the condition that the rigidities toward the pressures from the sides of the cylinder bores 4 at the portions of the bolt phases on the cylinder portions 5 are increased in this way. Accordingly, as mentioned above, the inverse deformations are added to the cylinder bores 4.

After finishing the honing process, the presses toward the wedge bodies 30 by the piston rods 71 are canceled. Specifically, the pressure oils supplied from the hydraulic pumps 74 are introduced from the solenoid changeover valves 73 via the second oil passages 75*b* into the upward hydraulic chambers 72*b* (the circuit condition is in the second condition), the piston rods 71 are biased toward the directions opposite to the pressing directions, thereby moving upward the wedge bodies 30. Accordingly, the engagements of the wedge bodies 30 to the pressing tops 20 are canceled, and the pressing tops 20 are removed from the bottom portion (hereinafter, referred to as "the jacket bottom portion) of the water jacket 6. The piston rods 71, the wedge bodies 30 and the pressing tops 20 are removed from the water jacket 6, with the rising of the hone guides 42.

An example of the changes (a controlling example) in the pressing loads applied to the wedge bodies 30, on the respective processes in the honing process for the cylinder bores 4 of the present embodiment, will be described, with respect to FIG. 6. In the graphs as shown in FIG. 6, the horizontal scale shows the time T, i.e., the courses in the respective processes performed during the finish processing for the cylinder bores 4. The longitudinal scale shows the oil pressures of the downward hydraulic chambers 72*a* (the downward hydraulic chamber oil pressures) Pd as the pressing loads applied to the wedge bodies 30.

Figure 6:
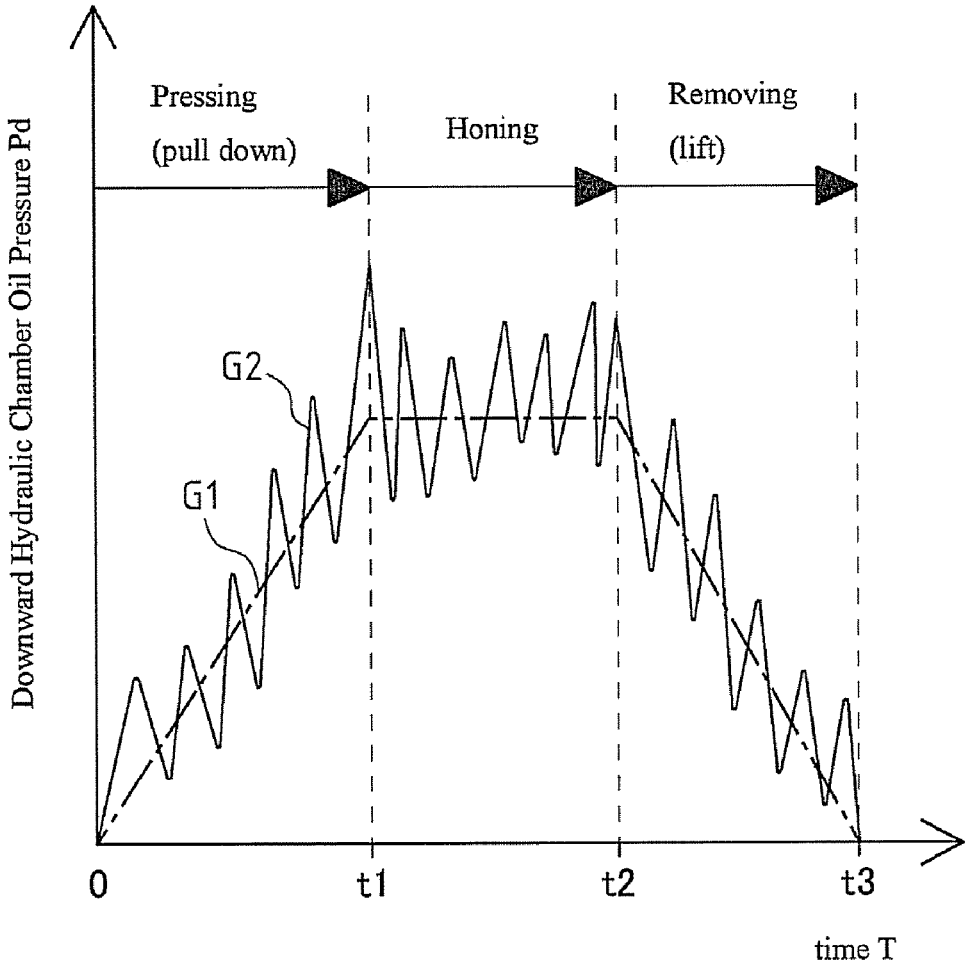
FIG. 6 is a diagram showing an example of change in loads added to the wedge body in the processing of the cylinder bore.

As shown in a graph G1 represented as a dashed-dotted line of FIG. 6, in order to press the wedge bodies 30 by the piston rods 71, the pressing loads applied to the wedge bodies 30, i.e., the downward hydraulic chamber oil pressures Pd are gradually increased (time T: 0 to t1). The increased downward hydraulic chamber oil pressures Pd are controlled so that they are constant values during the cutting process for the cylinder bores 4 (time T: t1 to t2). In other words, the pressing loads applied to the wedge bodies 30 during the processing for the cylinder bores 4 are kept constant. After finishing the bore processes, the piston rods 71 are moved upward, and the pressing tops 20 are removed from the jacket bottom portion, with the cancels of the engagements of the wedge bodies 30 to the pressing tops 20. Briefly, the downward hydraulic chamber oil pressures Pd controlled so as to be constant values are gradually decreased (the oil pressures of the upward hydraulic chambers 72*b* are increased) (time T: t2 to t3).

In the present embodiment that the finish processing for the cylinder bores 4 is performed as described above, it is preferable to cause the microscopic vibrations to the wedge bodies 30.

In the present embodiment, the pressing loads applied to the wedge bodies 30, i.e., the oil pressures in the hydraulic cylinder mechanisms are changed in a pulsatile fashion, thereby causing the microscopic vibrations to the wedge bodies 30. Specifically, in the hydraulic circuit configurations including the hydraulic cylinder mechanisms, due to the solenoid changeover valves 73, the first condition, where the piston rods 71 are moved downward, and the second condition, where the piston rods 71 are moved upward, are changed over in a pulsatile fashion at a fraction of the time. Accordingly, the piston rods 71 are vibrated, which causes the microscopic vibrations to the wedge bodies 30. In this regard, the method for causing the microscopic vibrations to the wedge bodies 30 is not limited to this. For example, on the first conditions in the hydraulic circuit configurations, the oil pressures supplied from the hydraulic pumps 74 via the solenoid changeover valves 73 into the downward hydraulic chambers 72*a* are changed in a pulsatile fashion or the like, so that the microscopic vibrations may be added to the wedge bodies 30.

The additions of the microscopic vibrations to the wedge bodies 30 are performed, during, at least, the pressings toward the wedge bodies 30 (the lowering of the piston rods 71), the bore processing and the cancels of the wedge actions on the wedge bodies 30 (the rising of the piston rods 71), on the respective processes in the finish processing for the cylinder bores 4. Briefly, as shown with a graph G2 represented in full line of FIG. 6, pulsatile changeovers of the first and second conditions on the hydraulic cylinder mechanisms are continuously performed, between the start of the pressing of the wedge bodies 30 and the end of the cancels of the wedge actions on the wedge bodies 30 (time T: 0 to t3). While the changeovers are performed, the downward hydraulic chamber oil pressures Pd are changed in a pulsatile fashion. Accordingly, the changes of the downward hydraulic chamber oil pressures Pd in a pulsatile fashion are transmitted to the wedge bodies 30 via the piston rods 71, thereby microscopically vibrating the wedge bodies 30. The pressing tops 20 engaged to the wedge bodies 30 are shook and microscopically vibrated, due to the microscopic vibrations of the wedge bodies 30.

As seen from the above, in the jig for processing according to the present embodiment, the hydraulic cylinder mechanisms as the loads applying means cause the microscopic vibrations to the wedge bodies 30, by changing the pressing loads in a pulsatile fashion.

Thus, when the pressing tops 20 are removed from the jacket bottom portions by the rising of the piston rods 71, the pressing tops 20 are easy to be removed, by causing the microscopic vibrations to the wedge bodies 30.

Specifically, when the pressing tops 20 are removed from the jacket bottom portions, the frictional forces, between the pressing tops 20 and the forming faces of the water jacket 6 (specifically, between the outer peripheral surfaces 21*a* of the inside pressing portions 21 and the cylinder portion outer peripheral surfaces 15, and between the outer peripheral surfaces 22*a* of the outside pressing portions 22 and the jacket outside surfaces 16) become drags. When the pressing tops 20 are stationary (not vibrated), the frictional forces become static friction forces, but when the pressing tops 20 are microscopically vibrated (shook), they become dynamic friction forces.

Therefore, as mentioned above, the pressing tops 20 are shook so as to be microscopically vibrated, by microscopically vibrating the wedge bodies 30, so that the friction forces as the drags when the pressing tops 20 are removed from the jacket bottom portions become dynamic friction forces smaller than the static friction forces (which the friction coefficient μ is smaller). Accordingly, when the pressing tops 20 are removed from the jacket bottom portions, the friction forces as the drags are relatively small, so that the pressing tops 20 is easy to be removed. In other words, the friction coefficient μ on the friction forces between the pressing tops 20 and the forming faces of the water jacket 6 are maintained as the dynamic friction coefficients smaller than the static friction coefficients, by microscopically vibrating the wedge bodies 30, between the start of the pressing of the wedge bodies 30 and the end of the cancels of the wedge actions on the wedge bodies 30, so that the pressing tops 20 are easy to be removed from the jacket bottom portions.

In this way, the pressing tops 20 are easy to be removed from the jacket bottom portions, thereby being able to reduce the powers of equipments (such as the powers of the hydraulic pumps 74) to remove the pressing tops 20 from the jacket bottom portions after finishing the bore processing, so as to prevent the equipments from getting larger and reduce the cost.

The friction coefficients μ between the pressing tops 20 and the forming faces of the water jacket 6 become stable, by causing the microscopic vibrations the wedge bodies 30, on condition that the cylinder portion outer peripheral surfaces 15 are pressed by the pressing tops 20 due to the pressing of the wedge bodies 30, so that the variability in the pressing forces toward the cylinder portion outer peripheral surfaces 15 by the pressing tops 20 can be more effectively reduced.

Specifically, the forming faces of the water jacket 6 pressed by the pressing tops 20 so as to cause the inverse deformation to the cylinder bores 4 (the cylinder portion outer peripheral surfaces 15 and the jacket outside surface 16) are casting surfaces, and the surface roughness thereof are relatively rough. In this respect, the pressing tops 20 pressing on the cylinder portion outer peripheral surfaces 15 are shook by microscopically vibrate the wedge bodies 30, and the smoothing effects due to the friction on the forming faces of the water jacket 6, which are casting surfaces, can be achieved, by the microscopic vibrations of the pressing tops 20. Accordingly, the friction coefficients between the pressing tops 20 and the forming faces of the water jacket 6 become stable, so that the pressing loads added to the wedge bodies 30 are efficiently, stably transmitted as the pressing forces toward the cylinder portion outer peripheral surfaces 15 by the pressing tops 20. As a result, the variability in the pressing forces toward the cylinder portion outer peripheral surfaces 15 by the pressing tops 20 is reduced, on the same inputs into the respective wedge bodies 30, thereby being able to stably generate the desired deformations on the cylinder bores 4.

Meanwhile, as the present embodiment, in the construction that the oil pressures are used as the pressing loads applied to the wedge bodies 30, the connected constructions of the plurality of wedge bodies 30 that is realized by using the connecting ring 33 in the first embodiment can be adopted. Specifically, for example, plurality of piston rods 71 provided for the respective wedge bodies 30 are integrally connected at the rod portions 71*a* or the piston portions 71*b*, and all of the plurality of hydraulic chambers 72 supporting the respective piston rods 71 are communicated to each other so as to be constructed as one hydraulic chamber. Accordingly, the plurality of wedge bodies 30 are integrally connected. Due to the construction, the plurality of piston rods 71 integrally connected are integrally moved upward or downward by the common oil pressures, thereby interlocking the plurality of wedge bodies 30.

In the construction at which the plurality of wedge bodies 30 are connected, the supplies of the pressure oils to the hydraulic chambers 72 are adjusted by the solenoid changeover valves 73, so that the tuning on the pressing loads (the oil pressures) toward the wedge bodies 30, needed in case that, for example, the models of the cylinder block 1 are changed, can be omitted or the like, thereby simplifying the operations.

The third embodiment of the present invention will be described with reference to FIGS. 7 and 8.

In the present embodiment, as with the second embodiment, load applying means, which applies the pressing loads to each of plurality of wedge bodies 30, are provided. In the present embodiment, the motor driving forces are utilized, as the pressing loads toward the wedge bodies 30.

Figure 7:
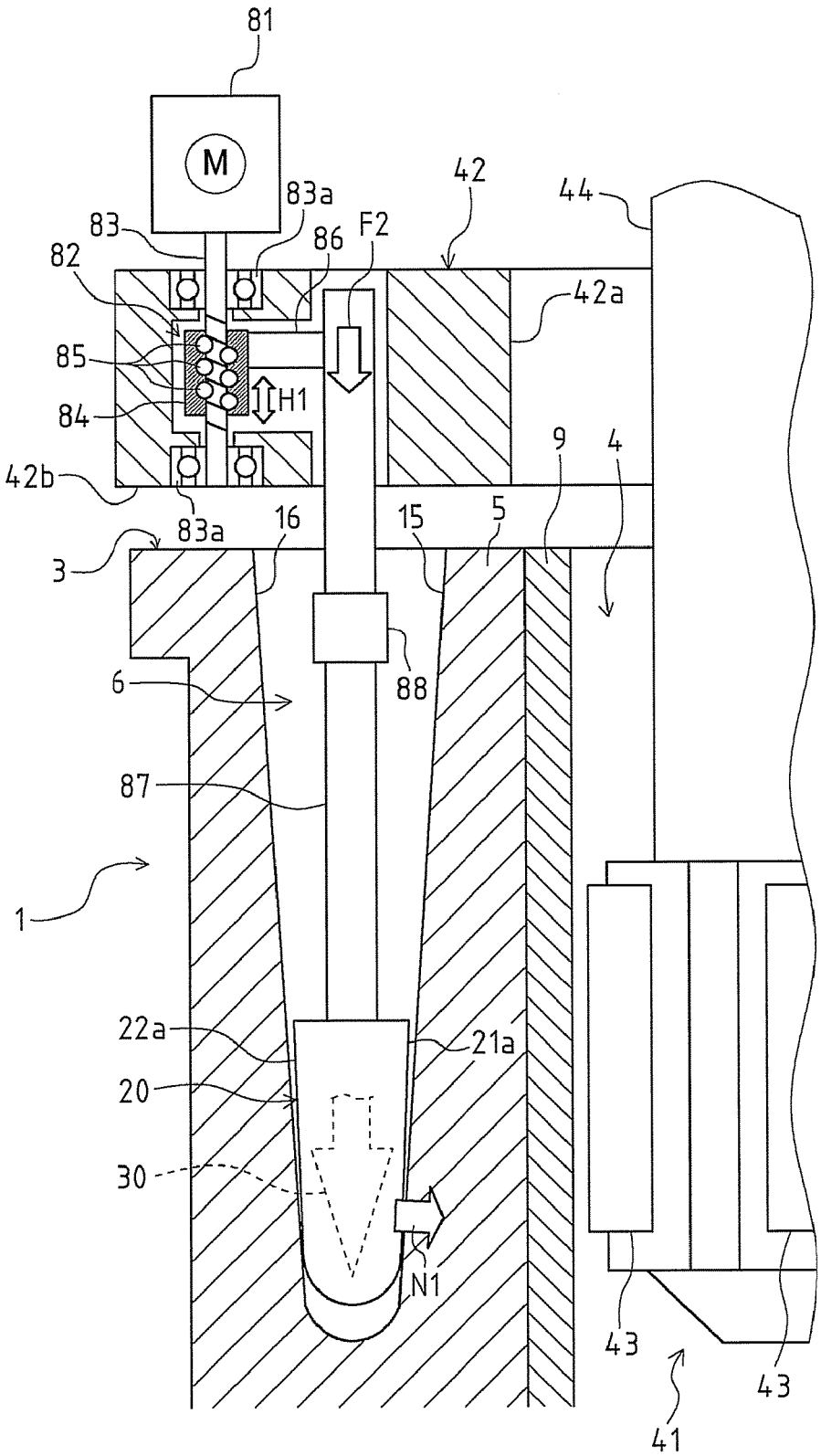
FIG. 7 is a diagram of constructions of a jig for processing and the like according to the third embodiment of the present invention.

Specifically, as shown in FIG. 7, the load applying means according to the present embodiment includes a motor 81 rotatably driven by the electricity. The driving force of the motor 81 is transmitted as the pressing loads toward the wedge bodies 30 via a ball screw unit 82 and a pressing rod 87. Briefly, the rotative power of the motor 81 is converted into the vertical straight line power by the ball screw unit 82, and the straight line power is transmitted to the wedge bodies 30 as the pressing loads via the pressing rod 87.

The driving force of the motor 81 is transmitted to the wedge bodies 30 via the ball screw unit 82 and the pressing rod 87, whereby the pressing loads are applied to the wedge bodies 30 and the pressing loads applied to plurality of wedge bodies 30 are equalized, by adjusting the driving force of the motor 81.

As shown in FIG. 7, in the present embodiment, as with the second embodiment, the hone guide 42 comprising the honing means for performing the honing process for the cylinder bores 4 is utilized, so as to constitute the load applying means. In other words, the motor 81, the ball screw unit 82 and the pressing rod 87 that constitute the load applying means are provided for he hone guide 42. Accordingly, the hone guide 42 incorporates the respective portions such as the ball screw unit 82, the pressing rod 87, and has a space allowing the operations of the respective portions or the like.

The ball screw unit 82 includes a threaded shaft 83 directly connected to the input shaft of the motor 81, a cylindrical sleeve 84 as a nut portion for the threaded shaft 83 and multiple balls 85 interposed between the threaded shaft 83 and the sleeve 84.

The threaded shaft 83 rotates by the driving force of the motor 81. The threaded shaft 83 is rotatably supported by a bearing 83*a* so as to vertically penetrate the hone guide 42. In this respect, the motor 81 rotating the threaded shaft 83 is supported at the predefined position by a supporting portion (not shown). The sleeve 84 engages the threaded shaft 83 via the balls 85. In the ball screw unit 82 having the above construction, when the threaded shaft 83 rotates by the driving force of the motor 81, the balls 85 move by rolling between the threaded shaft 83 and the sleeve 84, and accordingly, the sleeve 84 vertically moves along the threaded shaft 83 (see an arrow H1).

The pressing rod 87 is a rod member having a diameter that can be inserted into the water jacket 6. The pressing rod 87 transmits the driving force of the motor 81 converted into the straight line power in the ball screw unit 82 to the wedge bodies 30 as the pressing loads. The pressing rod 87 is connected to the sleeve 84 of the ball screw unit 82 via the connected portion 86. In other words, the vertical movement of the sleeve 84 of the ball screw unit 82 along the threaded shaft 83 is transmitted to the pressing rod 87 via the connected portion 86. The wedge body 30 is integrally or separately provided, (so as to be connected) on the side of the lower end portion of the pressing rod 87. The pressing top 20 is supported on the wedge body 30. The wedge body 30 receives the pressing load due to the downward force (hereinafter referred to as "the pressing axial force") (see an arrow F2) that the pressing rod 87 receives when the driving force of the motor 81 is transmitted via the ball screw unit 82 and the connected portion 86, thereby adding the wedge action to the pressing top 20 engaged to the wedge body 30. The given portions on the cylinder portion outer peripheral surface 15 are pressed due to the pressing top 20 that has received the wedge action (see an arrow N1).

Specifically, the pressings tops 20 inserted into the portions of the bolt phases on the water jacket 6 acquire the wedge actions from the wedge bodies 30 that has received the driving force of the motor 81 as the pressing loads via the ball screw unit 82 and the pressing rod 87, whereby the inside pressing portion 21 and the outside pressing portion 22 are disengaged to each other (see FIG. 3). Accordingly, the jacket outside surface 16 is pressed by the outer peripheral surface 22*a* of the outside pressing portion 22, and the cylinder portion outer peripheral surface 15 is pressed by the outer peripheral surface 21*a* of the inside pressing portion 21 (see the arrow N1).

As described above, in the present embodiment, the motor driving assembly is comprised of the motor 81, the ball screw unit 82 and the pressing rod 87, as the load applying means applying the pressing loads to the wedge bodies 30. The motor driving assemblies comprised of the motor 81, the ball screw unit 82 and the pressing rod 87 are provided for each of the wedge bodies 30 engaged to the pressing tops 20 inserted into the portions of the bolt phases on the cylinder block 1. Therefore, in the present embodiment that has ten portions of the bolt phases on the cylinder block 1, ten motor driving assemblies are provided as the load applying means for the respective wedge bodies 30.

The pressing loads applied to the respective wedge bodies 30 by the above-mentioned motor driving assemblies are equalized for all of the wedge bodies 30. In other words, the driving force of the motors 81 or the like are adjusted, so that the pressing axial forces added to the pressing rods 87 for applying the pressing loads to the wedge bodies 30 (see an arrow F2) are constant on all of the pressing rods 87.

In the present embodiment, an axial force meter 88 so as to measure the pressing axial force is used, for adjusting the driving force of the motor 81 or the like. The axial force meter 88 is a strain gauge type axial force meter provided on the pressing rod 87. The pressing axial forces, that are applied from the motor 81 via the ball screw unit 82 to the pressing rod 87 and applied to the wedge bodies 30 as the pressing load via the pressing rod 87 are measured, using the axial force meter 88. The driving force of the motor 81 or the like is adjusted, using the measurements on the pressing axial forces measured by the axial force meters 88.

As mentioned above, the changes of the pressing loads applied to the wedge bodies 30, on the respective processes of the honing process for the cylinder bores 4 in the present embodiment that the driving forces of the motors 81 are used as the processing loads toward the wedge bodies 30, are the same as those in the second embodiment.

Figure 8:
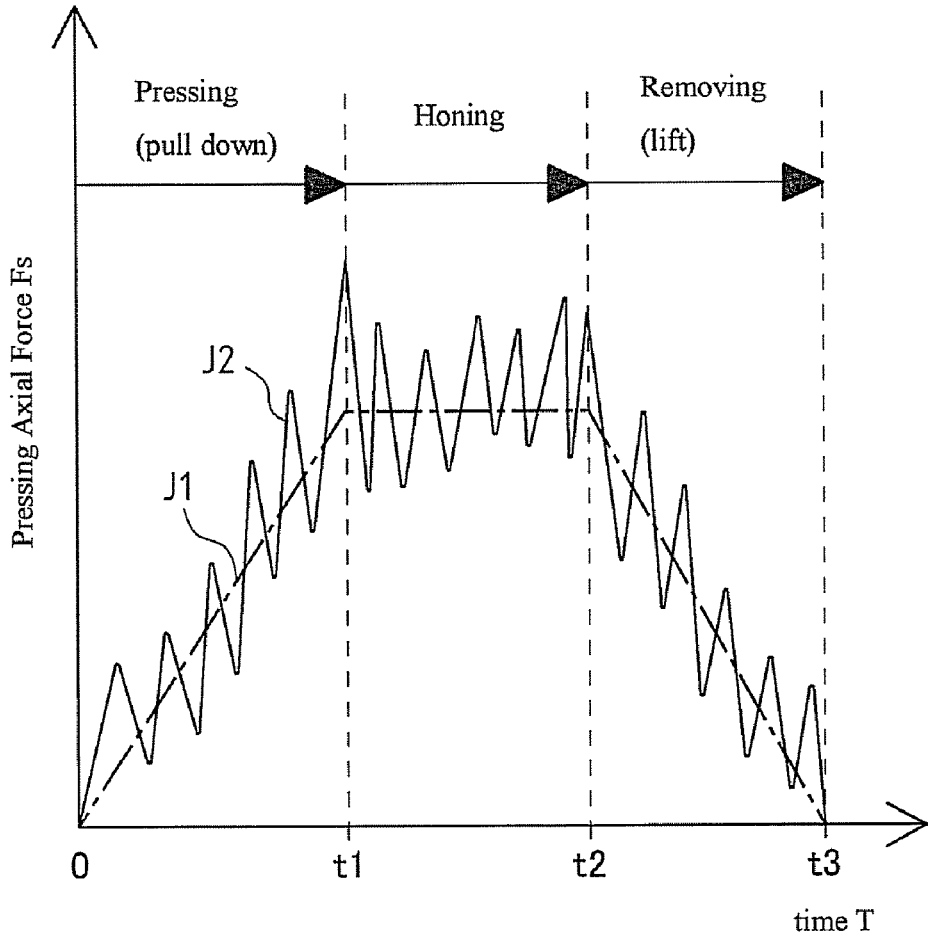
FIG. 8 is a diagram showing an example of change in loads added to the wedge body in the processing of the cylinder bore.

More specifically, as shown in a graph J1 represented as a dashed-dotted line of FIG. 8, first, when the wedge body 30 is pressed due to the pressing rod 87, the pressing load applied to the wedge body 30, i.e., the pressing axial force Fs is gradually increased (time T:0 to t1). The increased pressing axial force Fs is controlled so as to be constant value during the cutting work for the cylinder bores 4 (time T: t1 to t2). Briefly, during the work for the cylinder bores 4, the pressing load applied to the wedge body 30 is kept constant. After finishing the bore process, the pressing rod 87 is moved upward, the pressing top 20 is remove from the jacket bottom portion, with the cancel in the engagement of the wedge body 30 to the pressing top 20. Briefly, the pressing axial force Fs controlled so as to be constant value is gradually decreased (time T: t2 to t3).

When the pressing load is applied to the wedge body 30, as with the second embodiment, the microscopic vibration is caused to the wedge body 30. Specifically, the rotational direction of the motor 81 is changed over in a pulsatile fashion at a fraction of the time. Accordingly, the rotational direction of the threaded shaft 83 is changed over in a pulsatile fashion at a fraction of the time, and the pressing rod 87 is vertically shook via the sleeve 84 and the connected portion 86, thereby causing the microscopic vibration to the wedge body 30.

The addition of the microscopic vibration to the wedge body 30 is performed, during, at least, the pressing toward the wedge body 30 (the lowering of the pressing rod 87), the bore processing and the cancel of the wedge action on the wedge body 30 (the rising of the pressing rod 87), on the respective processes in the finish processing for the cylinder bores 4 as mentioned before. Briefly, as shown with a graph J2 represented in full line of FIG. 8, the pulsatile changeover in the rotational direction of the motor 81 is continuously preformed, between the start of the pressing of the wedge body 30 and the end of the cancel of the wedge action on the wedge body 30 (time T: 0 to t3). While the changeover in the rotational direction of the motor 81 is performed, the pressing axial force Fs is changed in a pulsatile fashion. Accordingly, the pulsatile change of the pressing axial force Fs is transmitted to the wedge body 30 via the pressing rod 87, thereby causing the microscopic vibration to the wedge body 30. The pressing top 20 engaged to the wedge body 30 is vibrated, due to the microscopic vibration to the wedge body 30.

As seen from the above, in the present embodiment, also, when the pressing top 20 is removed from the jacket bottom portion by the rising of the piston rod 71, the pressing top 20 is easy to be removed, by causing the microscopic vibration to the wedge body 30.

As the present embodiment, also, in the configuration that the driving force of the motor is utilized as the pressing load applied to the wedge body 30, the connected construction of plurality of wedge bodies 30 that is realized by using the connecting ring 33 in the first embodiment can be adopted. Specifically, for example, a plurality of pressing rods 87 provided for the respective wedge bodies 30 are integrally connected to each other. As a result, a plurality of wedge bodies 30 are integrally connected. Due to the above construction, the driving force of the motors is transmitted via the ball screw units or the like, so that the plurality of pressing rods 87 integrally connected integrally move upward or downward, thereby interlocking the plurality of wedge bodies 30.

The fourth embodiment of the present invention will be described with reference to FIGS. 9 to 11.

In the processing method for the cylinder block 51 according to the present embodiment, as with the first embodiment, when the finish processing for the cylinder bores 4 is performed in the cylinder block 51, the rigidities toward the pressures form the sides of the cylinder bores 4 at the portions of the bolt phases are relatively increased compared to the portions of the other phases, in the cylinder portion 5.

Figure 9:
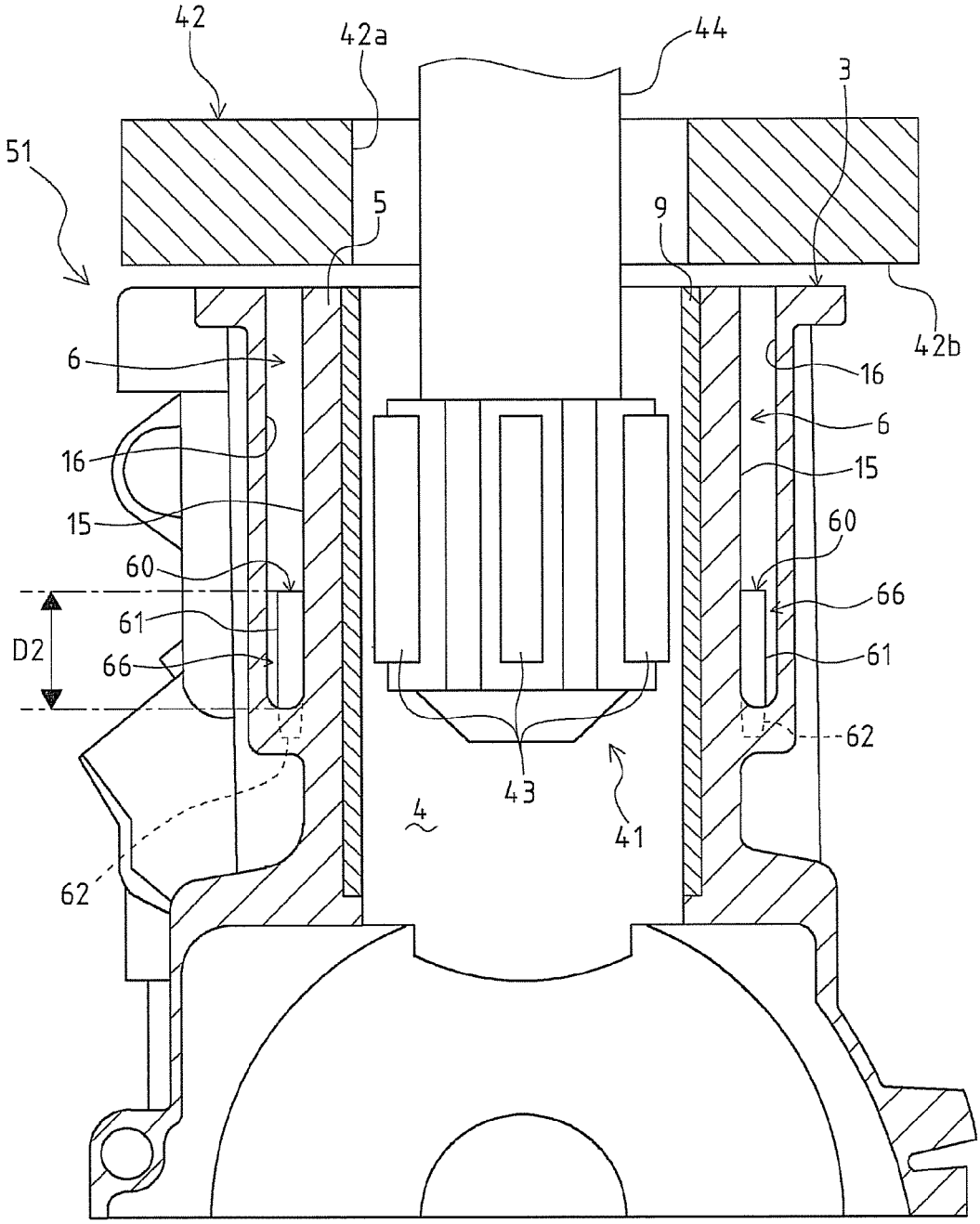
FIG. 9 is a cross-sectional view of constructions of a cylinder block and the like according to the forth embodiment of the present invention.
Figure 10:
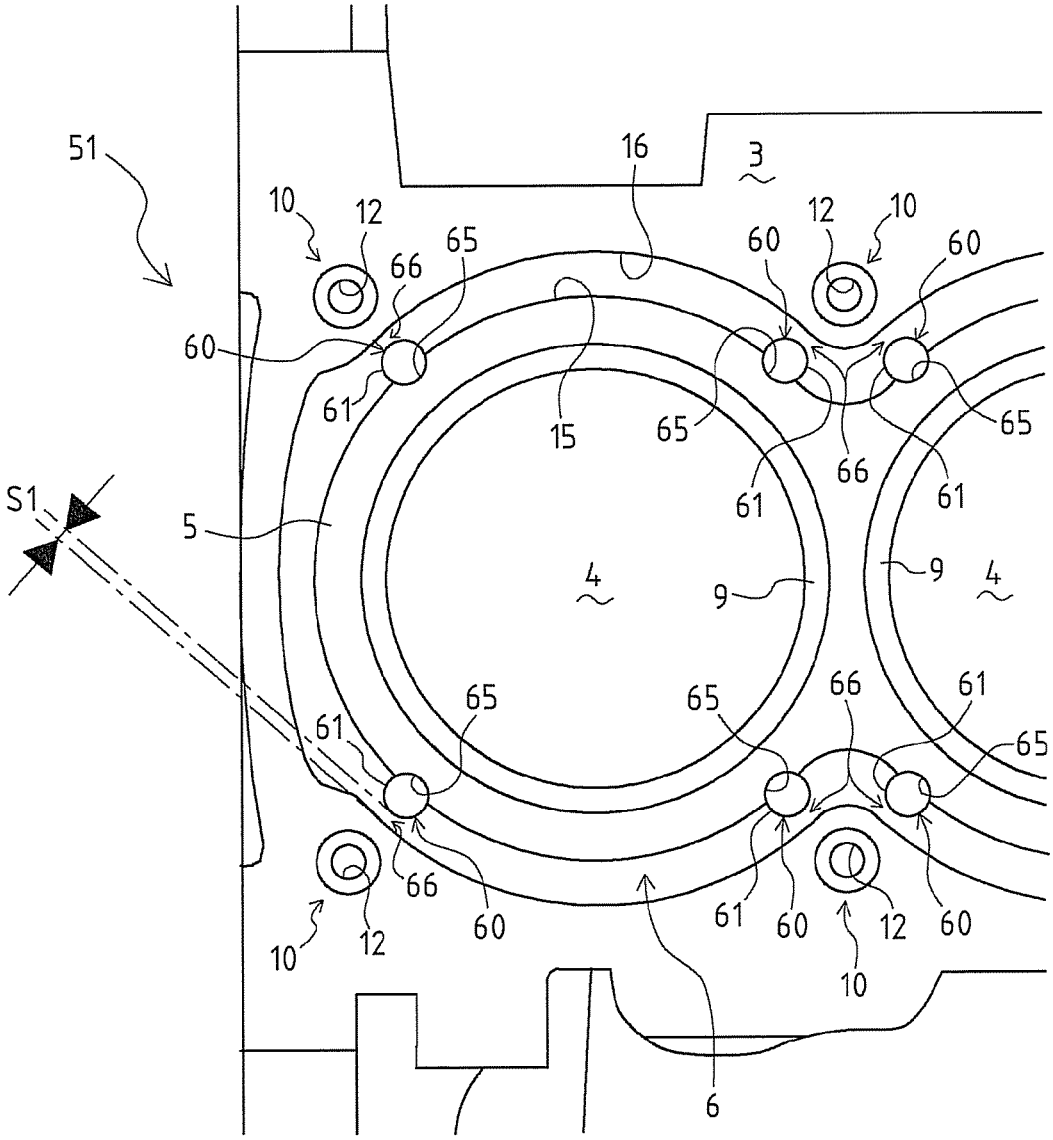
FIG. 10 is a plane view of the cylinder block according to the forth embodiment of the present invention.

In the processing method for the cylinder block 51 according to the present embodiment, as shown in FIGS. 9 and 10, so as to press on the portions of the bolt phases on the cylinder portion outer peripheral surfaces 15, the portions of the bolt phases on the cylinder portion outer peripheral surfaces 15 are pressed, by pressing pins 60 as pin members having diameters that can be inserted from the sides of the jacket opening portions of the water jacket 6 into the bottom portions of the water jacket 6 (the jacket bottom portions), on the condition that the outer peripheral surfaces 61 thereof (hereinafter, referred to as "pin outer peripheral surface") are pressurized so as to contact the portions of the bolt phases on the cylinder portion outer peripheral surfaces 15 (see the angular range $\alpha$1 in FIG. 2).

The pins 60 are constructed so that they have rigidities of the extent that can add the pressing actions to the cylinder portions 5 of the cylinder block 51. Therefore, while the material comprising the body of the cylinder block 51 is aluminum, as the materials comprising the pins 60, for example, the iron materials are used, and the pins 60 are formed so that they have higher rigidities than the body of the cylinder block 51.

The pins 60 are approximately cylindrical rod members in the present embodiment, and as mentioned above, they have diameters that can be inserted from the sides of the jacket opening portions of the water jacket 6.

The pins 60 are pressed into the portions that the cylinder portion outer peripheral surfaces 15 and the jacket outside surfaces 16 forming the water jacket 6 are continued, on the jacket bottom portions, i.e., on the opposite side to the side of the jacket opening portions. Briefly, as shown in FIG. 9, the pins 60 pressed into the water jacket 6, on the one end portions (the lower end portions) thereof, have buried portions 62 pressed into holes formed on the sides of the cylinder block 51, the parts of which are buried into the cylinder block 51.

When the pins 60 are pressed into the jacket bottom portions, the pin outer peripheral surfaces 61 are pressurized so as to contact the cylinder portion outer peripheral surfaces 15.

Recessed portions 65 along the configurations of the pin outer peripheral surfaces 61 are occasionally formed, at the contacting portions of the pins 60 on the cylinder portion outer peripheral surfaces 15. The pins 60, which are fitted onto the recessed portions 65, are pressed into the jacket bottom portions. In other words, the pins 60, which are pressed into the jacket bottom portions, are pressurized so as to contact the recessed portions 65, thereby being able to adjust the contacting area of the pins 60 with the cylinder portion outer peripheral surfaces 15, by controlling the sizes of the recessed portions 65. Thus, the diameters that can be inserted from the sides of the jacket opening portions in the pins 60 means those considering the existences of the recessed portions 65.

In this way, the pins 60 pressed into the jacket bottom portions are pressurized so as to contact the cylinder portion outer peripheral surfaces 15, so that the predetermined portions on the cylinder portion outer peripheral surfaces 15 are pressed.

In this regard, the pressing forces toward the cylinder portion outer peripheral surfaces 15 by the pins 60 are controlled by the angles of pressing the pins 60 into the jacket bottom portions or the like.

As described above, the pressing toward cylinder portion outer peripheral surfaces 15 due to the press fit of the pins 60 are performed at the portions of the bolt phases on the cylinder portion outer peripheral surfaces 15. In other words, the pins 60 are inserted and pressed into the portions corresponding to the portions of the bolt phases on the cylinder portion outer peripheral surfaces 15 in the water jacket 6.

With respect to the pressed portions on the cylinder portion outer peripheral surfaces 15 by the pins 60, the height ranges thereof (the heights in the vertical direction) are equivalent to those of the portions (hereinafter, simply referred to as "the exposed portions") exposed into the water jacket 6 out of the pins 60 inserted and pressed into the water jacket 6. In other words, the ranges between the arrows shown as a referential mark D2 in FIG. 9 are equivalent to the heights of the exposed portions of the pins 60, which becomes the portions that the pin outer peripheral surfaces 61 contact the cylinder portion outer peripheral surfaces 15. The portions that pin outer peripheral surfaces 61 contact the cylinder portion outer peripheral surfaces 15 become the height ranges at the pressed portions toward the cylinder portion outer peripheral surfaces 15 by the pins 60.

Incidentally, the height ranges at the pressed portions toward the cylinder portion outer peripheral surfaces 15 by the pins 60, i.e., the heights at the exposed portions of the pins 60 are occasionally set up, depending on the configuration of the cylinder block 51 or the like.

Thus, the given portions pressed by the pins 60, which become the portions contacting the pin outer peripheral surfaces 61 on the cylinder portion outer peripheral surfaces 15, are portions of the bolt phases, which become the portions of the height ranges equivalent to the heights (see the referential mark D2) of the exposed portions of the pins 60 inserted and pressed into the water jacket 6.

The portions pressed by the pins 60 on the cylinder portion outer peripheral surfaces 15 become the portions that the rigidities toward the pressures from the sides of the cylinder bores 4 are increased.

As described above, in the processing method for the cylinder block 51 according to the present embodiment, the finish processing for the cylinder bores 4 is performed, on the condition that the portions of the bolt phases on the cylinder portion outer peripheral surfaces 15 are pressed, by using the pins 60, so as to increase the rigidities toward the pressures from the sides of the cylinder bores 4, at the pressed portions in the cylinder portions 5, compared with the other portions.

Accordingly, as with the first embodiment, during the finish processing for the cylinder bores 4 in the cylinder block 51, the deformations in the direction opposite to the bore deformation caused at the time of actual working of the engine to the cylinder bores 4 after the finish processing can be added, without leading to the complexity of the working process and the increase in cost caused by using the jig for processing such as the dummy head, thereby being able to restrain the deterioration of the circularity of the cylinder bores 4 at the time of actual working of the engine.

In the processing method for the cylinder block 51 according to the present embodiment, it is preferable to comprise the pins 60 using the materials having the lower heat conductivity than those comprising the body of the cylinder block 51, and provide the spaces 66 of the extent that do not contact the pin outer peripheral surfaces 61 and the jacket outside surfaces 16 to each other, due to the heat expansion at the actual working of the internal-combustion engine consisting of at least the cylinder block 51, between the pin outer peripheral surfaces 61 of the pins 60 on the pressed conditions as mentioned above and the jacket outside surfaces 16.

As mentioned above, the pins 60 are constructed so that they have higher rigidities than the body of the cylinder block 51. Therefore, in this case, the materials, by which the pins 60 have higher rigidities than the cylinder block 51, having the lower heat conductivity than those comprising the body of the cylinder block 51, are utilized, as the materials comprising the pins 60.

Specifically, while, as the present embodiment, the material comprising the body of the cylinder block 51 is aluminum, examples of the materials comprising the pins 60 include iron (Fe) or the like.

For the pins 60 pressed into the bottom portions of the water jacket 6, the spaces 66 are provided between the pin outer peripheral surfaces 61 and the jacket outside surfaces 16, as the interval is represented by the referential mark S1 in FIG. 10. In the pins 60 pressed into the bottom portions of the water jacket 6, the pin outer peripheral surfaces 61 thereof are pressurized so as to contact the cylinder portion outer peripheral surfaces 15, and are at the interval S1 distance from the jacket outside surfaces 16.

The spaces 66 between the pins 60 and the jacket outside surfaces 16 are set up to be the sizes of the extent that the pin outer peripheral surfaces 61 and the jacket outside surfaces 16 do not contact to each other, due to the heat expansion at the actual working of the internal-combustion engine comprised of at least the cylinder block 51 as mentioned above.

Specifically, at the actual working of the internal combustion engine, the temperature of the cylinder bore 4 is increased due to the explosion, combustion or the like of the fuel-air mixture in the combustion chamber. For this reason, at the actual working of the internal combustion engine, the portions of the cylinder portions 5 forming the cylinder bores 4 in the cylinder block 51 are relatively at high temperature, thereby enlarging the heat expansion at the portions thereof. The pins 60 pressurized so as to contact the cylinder portion outer peripheral surfaces 15 are displaced outward (radially-outward in the cylinder bores 4), with their heat expansions, accompanying the heat expansion of the cylinder portions 5.

Due to the heat expansions in the respective portions at the actual working of the internal combustion engine, the spaces 66 are provided between the pin outer peripheral surfaces 61 of the pins 60 pressed into the bottom portions of the water jacket 6 and the jacket outside surfaces 16, so that the pin outer peripheral surfaces 61 and the jacket outside surfaces 16 do not contact to each other.

Incidentally, the time of actual working of the internal combustion engine is the condition of the so-called actual usage environment of the internal combustion engine, which means the operating condition (the loads, the rotational speed, the temperature or the like) of the internal combustion engine ordinarily used (at the commonly-used range). In this regard, the sizes of the intervals S1 in the spaces 66 can be occasionally set up depending on the usage environment of the internal combustion engine.

The spaces 66 between the pin outer peripheral surfaces 61 and the jacket outside surfaces 16 are provided for each of the pins 60 pressed into the portions of the respective bolt phases.

In this way, the pins 60 are made up of the materials having lower thermal conductivity than those comprising of the body of the cylinder block 51, and the forgoing spaces 66 are provided between the pin outer peripheral surfaces 61 and the jacket outside surfaces 16, for the pins 60 on the pressed conditions, thereby being able to restrain the bore deformations caused at the actual working of the internal combustion engine (at the actual working of the engine), so as to prevent the deteriorations in the circularity of the cylinder bores 4 at the actual working of the engine.

More specifically, in the cylinder portions 5, as the portions of the bolt phases contacting the pins 60 made up of the material having the lower thermal conductivity than those comprising of the body of the cylinder block 51 with the cylinder portion outer peripheral surfaces 15 have the lower cooling efficiency than those of the non-bolt phases, due to the bore cooling by the cooling water flowing into the water jacket 6, they are relatively weakly cooled. Accordingly, the temperatures at the portions of the bolt phases on the cylinder portions 5, at the time of actual working of the engine, are relatively increased than those at the portions of the non-bolt phases. Therefore, the heat expansions at the portions of the bolt phases on the cylinder portions 5 are relatively enlarged than those at the portions of the non-bolt phases. As a result, the deteriorations in the circularity of the cylinder bores 4 at the time of actual working of the engine are restrained.

Herein, the restraint of the deteriorations in the circularity of the cylinder bores 4 at the time of actual working of the engine will be described with reference to FIG. 11. In FIG. 11, (*a*) is a diagram of the bore deformation at the time of actual working of the engine according to the present embodiment, and (*b*) is a diagram of conventional bore deformation at the time of actual working of the engine.

The cylinder heads are assembled into the cylinder block 51 by the bolt fastening. As shown in FIG. 11, at the respective bolt fastenings 10 on the cylinder block 51, the head bolts 11 are threaded into the bolt holes 12.

The tightening forces by the head bolts 11 exert on the cylinder block 51, by assembling the cylinder heads into the cylinder block 51, thereby causing the assembly deformation to the cylinder bore 4. In the configuration that four bolt fastening portions 10 are provided at approximately equal spaces on the periphery of the cylinder bore 4 as the present embodiment, the assembly deformation becomes that as cross-like figure (fourth-order deformations), as shown by a dotted line B1 representing the shape of the cylinder bore 4 having assembly deformation in FIG. 11.

At the time of actual working of the engine made up of the cylinder block into which the cylinder heads are assembled by the head bolts 11, the bore deformation caused by the heat loads (the heat stresses) such as the heat expansions or the heat distortions at the time of actual working of the engine (hereinafter, referred to as "the heat deformation") are caused, in addition to the assembly deformation as mentioned before.

Figure 11:
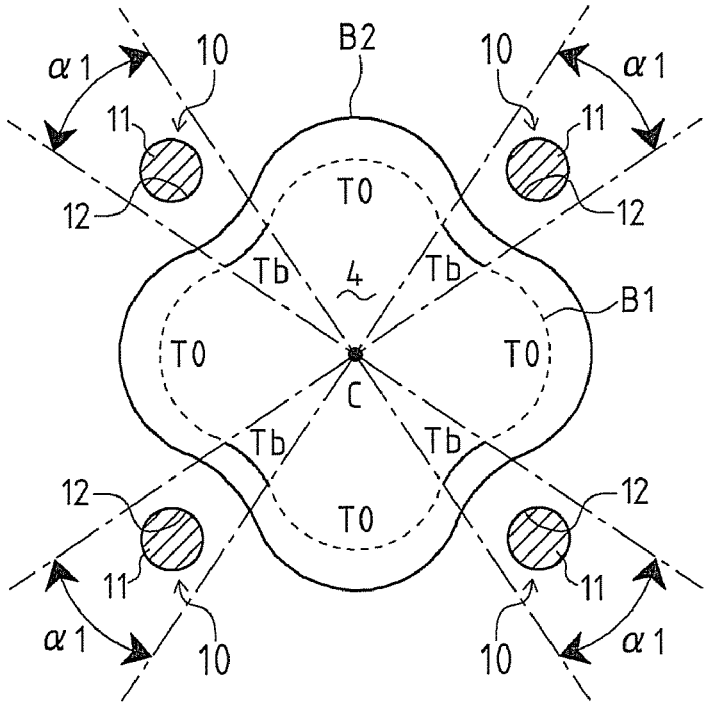
FIG. 11 is a pattern diagram showing a bore deformation at the time of actual working of the engine.
Figure 11:
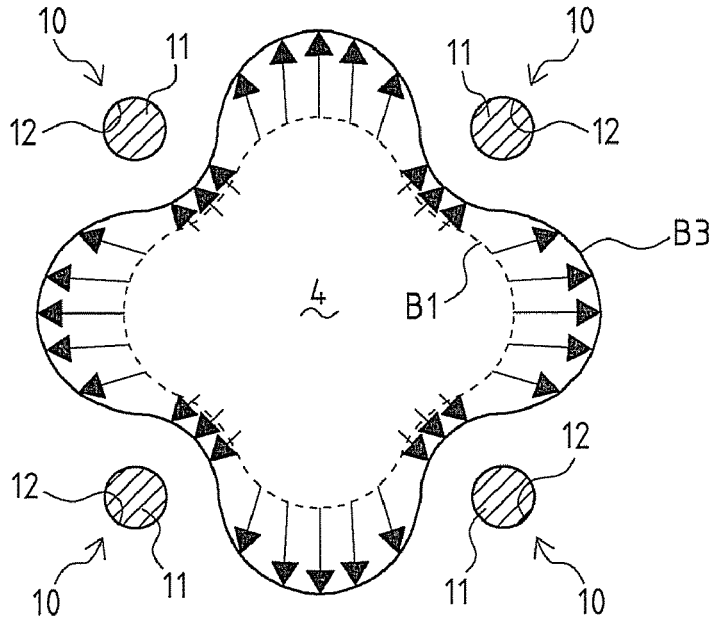
Figure 12:
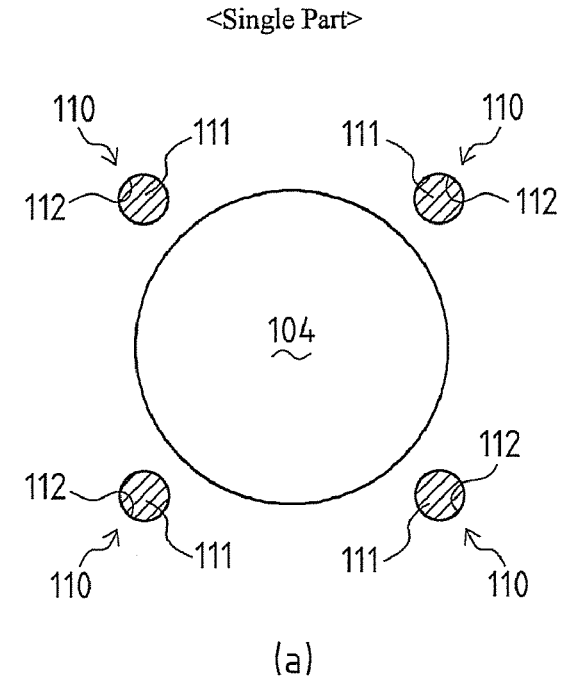
FIG. 12 is a pattern diagram showing a configuration of a bolt fastening portion and the bore deformation in the cylinder bore.
Figure 12:
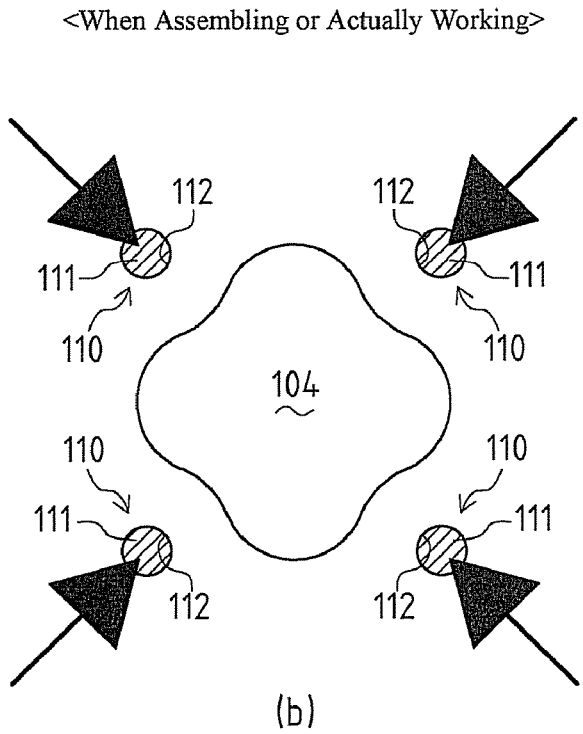

As shown in FIG. 11(*b*), the conventional heat deformation caused at the time of actual working of the engine becomes the deformation that the cross-like figure thereof is emphasized, in the cylinder bore having the assembly deformation (see a dotted line B1). This is due to the following reasons. That is to say, at the time of actual working of the engine, the temperature in the cylinder block 51 is increased, and the cylinder bore 4 is expanded in the circumferential direction. On this occasion, the deformations at the portions of the bolt phases are restrained due to the bolt axial forces by the fastening of the head bolts 11. For this reason, as shown by arrows in FIG. 11(*b*), the portions of the phases other than the bolt phases in the cylinder bore 4 is more expanded than those of the bolt phases, so that the bore deformation becomes the deformation that the cross-like figure thereof is emphasized (see a continuous line B3).

In this regard, as described above, the pins 60 pressed into the portions of the bolt phases at the cylinder portion outer peripheral surfaces 15 are constructed so that they have the higher heat conductivity than the cylinder block 51, and, as shown in FIG. 11 (*a*), in the configurations that four bolt fastening portions 10 are provided at approximately equal spaces on the periphery of the cylinder bore 4, when the temperature at the portions of the bolt phases having the given angular ranges $\alpha 1$ centered around a position C of a central axis of the cylinder bore 4 (see a continuous line portion in the dotted line B1) is defined as Tb, and when the temperature at the portions of the non-bolt phases is defined as T0, an inequality represented by Tb>T0 is true.

For this reason, with respect to the deformation (the heat deformation) of the cylinder bore 4 at the time of actual working of the engine, the expanding volumes at the portions of the bolt phases to at those of the portions of the non-bolt phases are relatively increased, so that the overall expansion around the circumferential directions in the cylinder bore 4 is equalized, as shown by the continuous line B2 representing the shape of the cylinder bore 4 having the heat deformation in FIG. 11 (*a*). As a result, the deterioration in the circularity of the cylinder bore 4 at the time of actual working of the engine is restrained, thereby improving the circularity thereof.

Therefore, as described above, the spaces 66 provided between the pin outer peripheral surfaces 61 of the pins 60 pressed into the bottom portions of the water jacket 6 and the jacket outside surfaces 16 allow the heat expansions (the broadening) of the portions of the bolt phases on the cylinder bore 4 in the circumferential directions, during the heat deformation caused at the time of actual working of the engine.

Thus, in the cylinder block 51 according to the present embodiment, the pins 60 for use in the finish processing for the cylinder bores 4 become pressed into the bottom portions of the water jacket 6 during the finish processing. The internal combustion engine is comprised of the cylinder block 51 having the pins 60 on the pressed condition.

The cylinder block 51 according to the present embodiment is formed by using the pins 60 made up of the materials having the lower heat conductivity than the material comprising of the body of the cylinder block 1, and has the pins 60 pressed on the condition of having the spaces 66 between the pin outer peripheral surfaces 61 and the jacket outside surfaces 16 as mentioned before.

Due to the internal combustion engine made up of the above-mentioned cylinder block 51, with regard to the bore deformation, the heat deformation caused at the time of actual working of the engine can be also prevented, in addition of the prevention of the assembly deformation caused during the assembly of the cylinder heads.

Industrial Applicability

The processing method, the jig for processing for the cylinder block and the cylinder block according to the present invention are industrially applicable, in that they add the deformations in the directions opposite to the bore deformations caused at the time of actual working of the engine to the cylinder bores after the finish processing without leading to the complexity of the working process and the increase in cost, which are caused by using the jig for processing such as the dummy head, as well as in that they can restrain the deteriorations in the circularity of the cylinder bores at the time of actual working of the engine, during the finish processing for the cylinder bores in the cylinder block.

The invention claimed is:

1. A processing method for a cylinder block including a cylinder bore having a cylindrical opening being slidable with an incorporated piston and provided on a cylinder head mounting surface for fixing a cylinder head by fastening members, and including a water jacket formed as a wall surrounding the cylinder bore via a cylinder portion, the processing method comprising:

pressing portions of a periphery of the cylinder portion forming an inner surface of the water jacket, the portions corresponding to fastened portions by the fastening members in a circular shape of the cylinder bore, for enhancing a rigidity of the cylinder portion against pressure from the pressed portion compared with other portions of the cylinder portion; and performing a finish processing for the cylinder bore.

2. The processing method according to claim 1, further comprising:

preparing a pressing member having a wedge surface containing pressing portions separatably connected with each other and receiving a wedge action in a separating direction of the pressing portions, and a wedge member engaging to the wedge surface for adding the wedge action, wherein the separating direction includes the pressing direction for the portion of the periphery of the cylinder portion; and wherein in the state where the wedge action is added from an opening portion of the water jacket toward the cylinder head mounting surface, the pressing member is engaged to the wedge member where the pressing members are inserted into the water jacket, the pressing member is pressed from a side of the opening portion for gaining the wedge action, thereby pressing the portion of the periphery of the cylinder portion.

3. The processing method according to claim 2, wherein the wedge members are engaged to each of the pressing members inserted for adding the wedge action to the portions of the periphery of the cylinder portion corresponding to the fastened portions, and the wedge members are connected to each other in disposing at a position corresponding to that of the inserted pressing members, and the pressing members are supported with the corresponding wedge members being capable of engaging; and wherein the wedge members are cooperated for pressing from the side of the opening portion.

4. The processing method according to claim 2, wherein the finish processing is a honing process, using a structure comprising a head portion, having a honing stone and moving to the cylinder bore for acting the honing stone on the cylinder bore, and a guide portion, being close to and separated from the cylinder head mounting surface for guiding the head portion;

wherein the wedge members are connected to the guide portion; and wherein making the guide portion close to the cylinder head mounting surface causes pressing of the wedge members from the side of the opening portion.

5. The processing method according to claim 2, further comprising:

providing a load applying device that applies loads to each of the wedge members engaged to each of the pressing members inserted for adding the wedge action to the portions of the periphery of the cylinder portion corresponding to the fastened portions, for pressing the wedge members from the side of the opening portions, wherein the load applying device equalizes the loads applied to the wedge member.

6. The processing method according to claim 5, wherein fluid pressures are used as the loads;

wherein the load applying device includes fluid pressure transmitting members provided to be biased toward the pressing direction of the wedge members from the side of the opening portions by the fluid pressures; and wherein the fluid pressures are transmitted to the wedge members via the fluid pressure transmitting members for applying the loads to the wedge members, and the fluid pressures are adjusted for equalizing the loads applied to the wedge members.

7. The processing method according to claim 6, wherein the finish processing is a honing process, using a structure comprising a head portion, having a honing stone and moving to the cylinder bore for acting the honing stone on the cylinder bore, and a guide portion, being close to and separated from the cylinder head mounting surface for guiding the head portion;

wherein the guide portion includes a hydraulic chamber for slidably supporting the fluid pressure transmitting members in a given direction containing the pressing direction and for acting the fluid pressures on the fluid pressure transmitting members.

8. The processing method according to claim 2, wherein the wedge members are minutely vibrated.

9. The processing method according to claim 1, further comprising:

providing a pin member having an outer diameter being capable of inserting to the water jacket from the side of the opening toward the cylinder head mounting surface;

pressing and inserting the pin member to a bottom of the water jacket, in contacting an outer periphery of the pin member to the portion of the periphery of the cylinder portion, thereby pressing the portion of the periphery of the cylinder portion.

10. The processing method according to claim 9, wherein the pin member has lower conductivity than a body of the cylinder block; and wherein between the outer periphery of the inserted pin member and an outer surface of the water jacket, a clearance exists not to contact the outer periphery of the pin member with the outer surface of the water jacket when a thermal expansion occurs in a working internal-combustion engine provided with the cylinder block.

* * * * *